US006636206B1

(12) United States Patent
Yatabe

(10) Patent No.: US 6,636,206 B1
(45) Date of Patent: Oct. 21, 2003

(54) SYSTEM AND METHOD OF DRIVING A DISPLAY DEVICE

(75) Inventor: Satoshi Yatabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 253 days.

(21) Appl. No.: 09/869,977

(22) PCT Filed: Nov. 20, 2000

(86) PCT No.: PCT/JP00/08186

§ 371 (c)(1),
(2), (4) Date: Jul. 10, 2001

(87) PCT Pub. No.: WO01/39165

PCT Pub. Date: May 31, 2001

(30) Foreign Application Priority Data

Dec. 19, 1999 (JP) ..... 11-329982

(51) Int. Cl.[7] ..... G09G 5/00

(52) U.S. Cl. ..... 345/204; 345/89; 345/96; 345/99; 345/100

(58) Field of Search ..... 345/204, 89, 96, 345/99, 100

(56) References Cited

U.S. PATENT DOCUMENTS 5,365,284 A * 11/1994 Matsumoto et al. ..... 348/793
6,040,814 A * 3/2000 Murakami et al. ..... 345/94

FOREIGN PATENT DOCUMENTS

JP A 58-72191 4/1983
JP A 2-135419 5/1990
JP A 8-160392 6/1996
JP A 9-244591 9/1997

* cited by examiner

*Primary Examiner*—Richard Hjerpe
*Assistant Examiner*—Jean Lesperance
(74) *Attorney, Agent, or Firm*—Oliff & Berridge, PLC

(57) ABSTRACT

Electric power consumed in an operation of displaying a gray-scale image is reduced. One of a plurality of scanning lines is selected during one horizontal scanning period, and a selection voltage is applied to the scanning line during one of a first half period and a second half period that said horizontal scanning period has been divided into. When an intermediate gray level is displayed, the selection voltage is applied to a scanning line in an odd-numbered column during the second half period and the selection voltage is applied to a scanning line in an even-numbered column during the first half period. To a pixel at a location corresponding to the selected scanning line, a turn-on voltage and a turn-off voltage are applied via a corresponding data line during particular periods within the period during which the selection voltage is applied such that the turn-on voltage is applied during a period with a length corresponding to a gray level while the turn-off voltage is applied during the remaining period. Thus, when an intermediate gray level is displayed by a pixel, the voltage level of the data signal Xi applied to the pixel is switched as few times as twice per horizontal scanning period, and thus electric power consumed in switching the voltage level is suppressed.

9 Claims, 21 Drawing Sheets

SYSTEM AND METHOD OF DRIVING A DISPLAY DEVICE

BACKGROUND OF THE INVENTION

1. Field of Invention

The present invention relates to a method of driving a display device such that a gray-scale image is displayed by using pulse width modulation with reduced electrical power consumption. The present invention also relates to a driver circuit based on such a method, a display device, and an electronic device.

2. Description of Related Art

In general, a portable electronic device includes a display device for presenting various kinds of information to a user. In such display devices, information is displayed using an electrooptical change in an electrooptical material. For example, liquid crystal display devices are widely used for this purpose. In recent years, it has become desirable that display devices be not only capable of simply providing an achromatic display (ON/OFF or two-value black and white), but also be capable of representing a large number of gray levels so that images of intermediate gray levels can be displayed.

However, in portable electronic devices which are powered by a battery, it is very important that the portable electronic devices operate with small power consumption. As is well known, extremely greater power consumption is needed to display a gray-scale image relative to that which is needed to display a simple black-and-white image. That is, in display devices for use in portable electronic devices, it is necessary to meet the requirements of having the capability of displaying a gray-scale image and having small power consumption, which often conflict with each other.

SUMMARY OF THE INVENTION

In view of the above, it is an object of the present invention to provide a method of driving a display device so as to display a gray-scale image without causing a significant increase in power consumption, a driver circuit for implementing the method and a display device using such a method, and an electronic device using such a display device.

According to a first aspect of the present invention, there is provided a method of driving a display device so as to display a gray-scale image by driving pixels disposed at locations corresponding to respective intersections of a plurality of scanning lines extending along rows and a plurality of data lines extending along columns. The method comprising the steps of: selecting a single scanning line from the plurality of scanning lines during one horizontal scanning period and applying a selection voltage to the scanning line during one of half periods of the horizontal scanning period; and selecting a single scanning line adjacent to the previously selected scanning line during following one horizontal scanning period and applying a selection voltage to the adjacent scanning line during the other one of the half periods of the horizontal scanning period; while at the same time applying a turn-on or turn-off voltage to a pixel at a location corresponding to a selected scanning line via a corresponding data line such that the turn-on voltage is applied during a period with a length corresponding to a gray level in the period during which the selection voltage is applied and the turn-off voltage is applied during the remaining period. In this first aspect of the present invention, a reduction is achieved in the number of times the voltage applied to a data line is switched between the turn-on voltage and the turn-off voltage during an operation of displaying pixels having intermediate gray levels, and thus it is possible to reduce electric power consumed in switching the voltage.

In this first aspect of the present invention, in the case where only white or black pixels are displayed and no intermediate gray levels are displayed, the number of times the voltage applied to a data line is switched between the turn-on voltage and the turn-off voltage does not decrease, and thus an increase in power consumption can occur. To avoid such a problem, in this first aspect of the present invention, it is specified whether or not the mode should be changed. In the case where it is specified that the mode should be changed, when the adjacent scanning line is selected in the following one horizontal scanning period, the selection voltage is preferably applied to the adjacent scanning line during one of half periods of the horizontal scanning period. That is, when an intermediate level is not displayed, the mode is changed to prevent an increase in power consumption.

A command to change the mode may be issued by an application, or a user. Alternatively, the gray level data associated with the pixels are examined, and a command to change the mode may be issued depending upon a result of the examination. In this case, it is preferable that the mode shift be specified when the number of pixels successively aligned along a column in which pixels will be displayed in a single color of either black or white exceeds a predetermined number of pixels located along a single scanning line that will be selected. This prevents an increase in power consumption.

Furthermore, in the first aspect of the present invention, it is preferable that the mode shift be prevented when pixels the number of pixels successively aligned along a column in which black and white pixels will be displayed alternately exceeds a predetermined number of pixels located along a single scanning line that will be selected. This is because if the mode is changed in such a case, an increase occurs in the number of times the voltage applied to the data line of the pixels is switched between the turn-on voltage and the turn-off voltage, and thus power consumption increases.

According to a second aspect of the present invention, in order to achieve the above-described object, there is provided a driver circuit for driving a display device so as to display a gray-scale image by driving pixels disposed at locations corresponding to respective intersections of a plurality of scanning lines extending along rows and a plurality of data lines extending along columns. The driver circuit comprising: a scanning line driver circuit for selecting out of said plurality of scanning lines a single scanning line during a horizontal scanning period and applying a selection voltage to the scanning line during one of two half periods that said horizontal scanning period has been divided into, and for selecting a single scanning line adjacent to the previously selected scanning line during the subsequent horizontal scanning period and applying a selection voltage to the adjacent scanning line during the other of the two half periods of said horizontal scanning period; and a data line driver circuit for applying a turn-on or turn-off voltage to a pixel at a location corresponding to the scanning line selected the scanning line driver circuit via a corresponding data line such that the turn-on voltage is applied during a period with a length corresponding to a gray level in the period during which said selection voltage is applied and the turn-off voltage is applied during the remaining period. According to this second aspect of the present invention, as with the first aspect of the present invention, a reduction can be achieved in the number of times the voltage applied to a data line is switched between the turn-on voltage and the turn-off voltage, and thus it is possible to reduce electric power consumed in switching the voltage.

According to a third aspect of the present invention, to achieve the above-described object, there is provided a display device for displaying a gray-scale image by driving pixels disposed at locations corresponding to respective intersections of a plurality of scanning lines extending along rows and a plurality of data lines extending along columns. The display device comprising: a scanning line driver circuit for selecting out of the plurality of scanning lines a single scanning line during a horizontal scanning period and a selection voltage to the scanning line during one of two half periods that the horizontal scanning period has been divided into, and selecting a single scanning line adjacent to the previously selected scanning line during the subsequent horizontal scanning period and applying a selection voltage to the adjacent scanning line during the other of the two half periods of the horizontal scanning period; and a data line driver circuit for applying a turn-on or turn-off voltage to a pixel at a location corresponding to the scanning line selected the scanning line driver circuit via a corresponding data line such that the turn-on voltage is applied during a period with a length corresponding to a gray level in the period during which said selection voltage is applied and the turn-off voltage is applied during the remaining period. According to this third aspect of the present invention, as with the first or the second aspect of the present invention, a reduction is achieved in the number of times the voltage applied to a data line is switched between the turn-on voltage and the turn-off voltage, and thus it is possible to reduce electric power consumed in switching the voltage.

In this third aspect of the present invention, the pixel preferably includes a switching element and a capacitor driven by the switching element. In this construction, a selected pixel and a non-selected pixel is electrically isolated from each other by the switching element, and thus good contrast and response can be obtained and a high-quality image can be displayed.

In this construction, the switching element is a thin film diode having a conductor/insulation/conductor structure. In this case, one end of the thin film diode is connected to either a scanning line or a data line, and the other end thereof is connected to the capacitor. When the thin film diode is used as the switching element, the production process becomes simpler. Besides, principally, no short-circuited path is created between a scanning line and a data line.

According to a fourth aspect of the present invention, there is provided an electronic device including a display device according to the previous aspect of the invention. The electronic device according to the present invention is capable of displaying a gray-scale image with reduced power consumption.

BRIEF DESCRIPTION OF THE DRAWINGS

The preferred embodiments of this invention will be described in detail, with reference to the following figures, wherein like reference numerals reference like elements, and wherein.

DETAILED DESCRIPTION OF PREFERRED EMBODIMENTS

Figure 1:
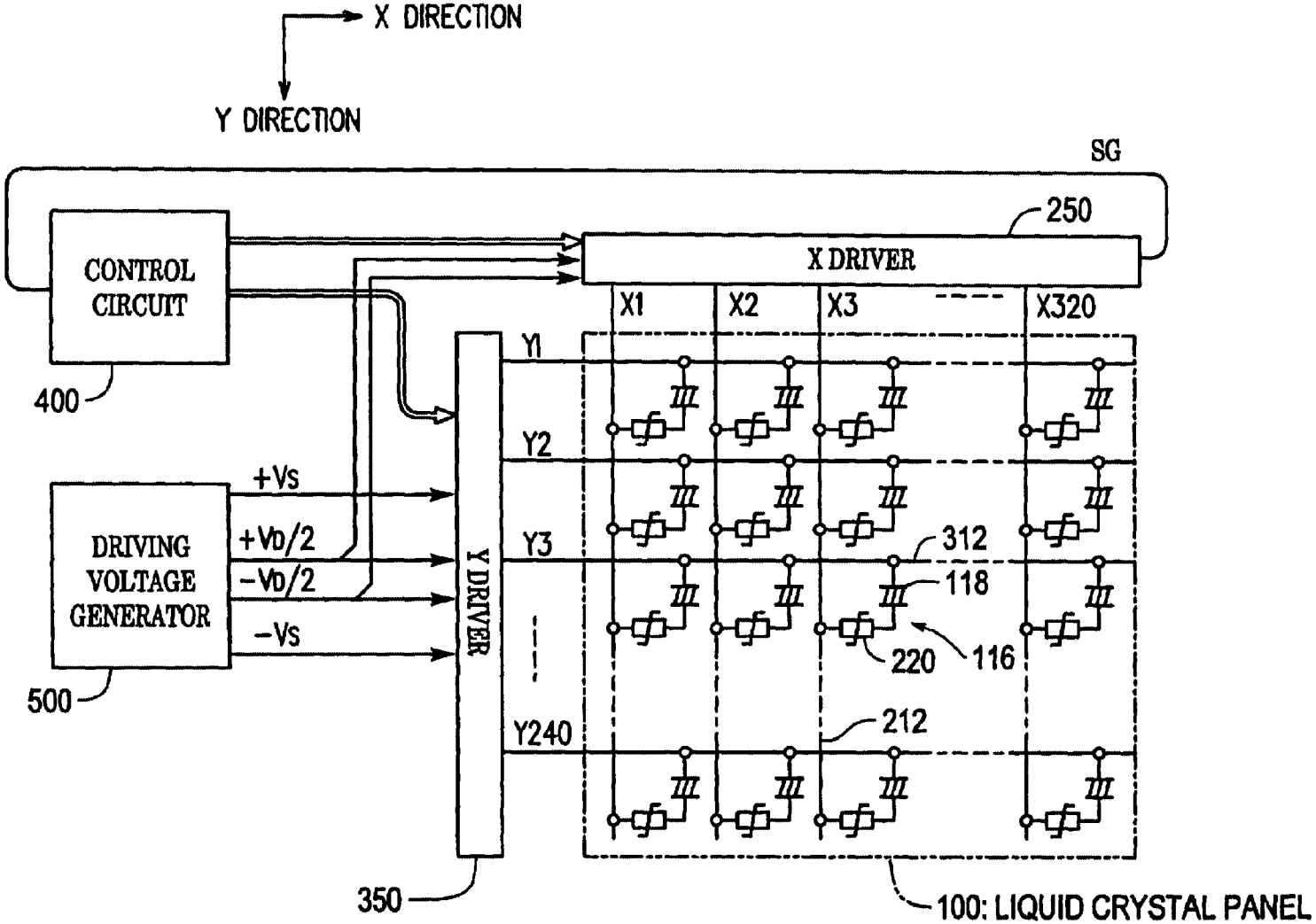
FIG. 1 is an exemplary block diagram illustrating the electrical configuration of a display device according to an embodiment of the present invention.

The electrical configuration of a display device according to an embodiment of the present invention is described below. FIG. 1 is an exemplary block diagram illustrating the electrical configuration of the display device. In a liquid crystal panel 100, as shown in FIG. 1, data lines such as segment electrodes 212 are formed so as to extend along columns (in a Y direction), and scanning lines such as common electrodes 312 are formed so as to extend along rows (in an X direction). In the present embodiment, by way of example but not of limitation, there are a total of 240 scanning lines 312 and a total of 320 data lines 212, and the display device is formed so as to serve as a 240×320 matrix display device. Pixels 116 are formed at respective locations corresponding to intersections of the data lines 212 and the scanning lines 312. Each pixel 116 is composed of a series connection of a liquid crystal layer 118 and a TFD (Thin Film Diode) 220 serving as a switching element.

A Y driver 350, which is also called a scanning line driver circuit, serves to supply scanning signal Y1, Y2, . . . , Y240 to corresponding scanning lines 312. More specifically, the Y driver 350 selects the scanning lines 312 one by one and applies a selection voltage to the selected scanning line during one of a first half period and a second half period of the selection period and applies a non-selection voltage to the selected scanning line during the other one of the first half period and the second half period of the selection period.

An X driver 250, which is also called a data line driver circuit, serves to supply data signals X1, X2, . . . , X320, corresponding to a content to be displayed, to pixels 116 located along a scanning line 312 selected by the Y driver 350, via corresponding data lines 212. The X driver 250 also outputs a discrimination signal SG to a control circuit 400. The discrimination signal SG specifies a mode according to the present embodiment, as will be described in greater detail later. The detailed structures of the X driver 250 and the Y driver will also be described later.

The control circuit 400 supplies various control signals and a clock signal to the X driver 250 and the Y driver 350 to control them. A driving voltage generator 500 generates voltages of ±VD/2 and ±VS, wherein voltages of ±VD/2 are used as data voltages of a data signal and also as non-selection voltages of a scanning signal, and voltages of ±VS are used as selection voltages of a scanning signal.

In the present embodiment, the polarities of voltages applied to the scanning lines 312 and the data lines 212 are defined such that the middle potential of the data voltages ±VD/2 applied to the data lines 212 is employed as a reference voltage and potentials higher than the reference voltage are regarded as positive and those lower than the reference voltage as negative.

Figure 2:
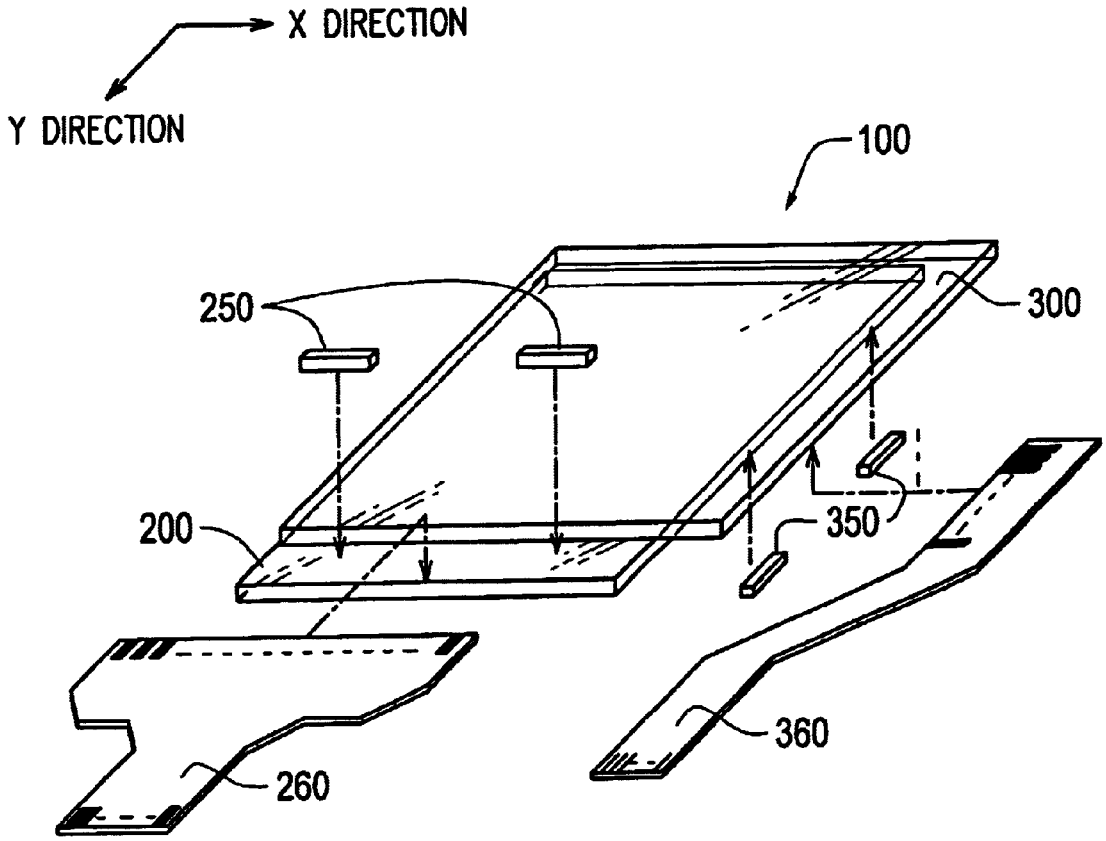
FIG. 2 is a perspective view illustrating the structure of a liquid crystal panel of the display device.

The mechanical structure of the display device according to the present embodiment is described below. FIG. 2 is a perspective view generally illustrating the structure of the display device. As shown in FIG. 2, the liquid crystal panel 100 includes a device substrate 200 and an opposite substrate 300 which are adhesively connected to each other. The device substrate 200 has a part extending outward beyond an edge of the opposite substrate 300, wherein the upper surface of this extending part serves as a terminal area. In this terminal area, the X driver 250 in the form of a bare chip is mounted by means of a COG (Chip On Glass) technique. Furthermore, one end of an FPC (Flexible Printed Circuit) board 260 is connected to the terminal area of the device substrate 200 so as to supply various signals to the X driver 250. Similarly, the opposite substrate 300 has a part extending outward beyond an edge of the device substrate 200, wherein the lower surface of this extending part serves as a terminal area. In this terminal area of the opposite substrate 300, the Y driver 350 in the form of a bare chip is mounted by means of a COG technique, and one end of an FPC board 360 is connected to the terminal area of the device substrate 300 so as to supply various signals to the Y driver 350. The other ends of the FPC substrates 260 and 360 are respectively connected to the control circuit 400 and the driving voltage generator 500 shown in FIG. 1.

The X driver 250 and the Y driver 350 are mounted as follows. First, they are placed at predetermined locations on the corresponding substrate such that anisotropic conductive films formed by uniformly dispersing conductive microparticles into an adhesive material are placed between the respective chips and the substrates. The bare chips of the X and Y drivers are pressed against the respective substrate while heating them. Connecting of the FPC substrates 260 and 360 is also performed in a similar manner. Instead of mounting the X driver 250 and the Y driver 350 on the device substrate 200 and the opposite substrate 300, respectively, they may be mounted on a TCP (Tape Carrier Package) and connected using a TAB (Tape Automated Bonding) technique such that electrical and mechanical connections of the X driver 250 and the Y driver 350 are achieved via an anisotropic conductive film disposed at a particular location on a substrate.

Figure 3:
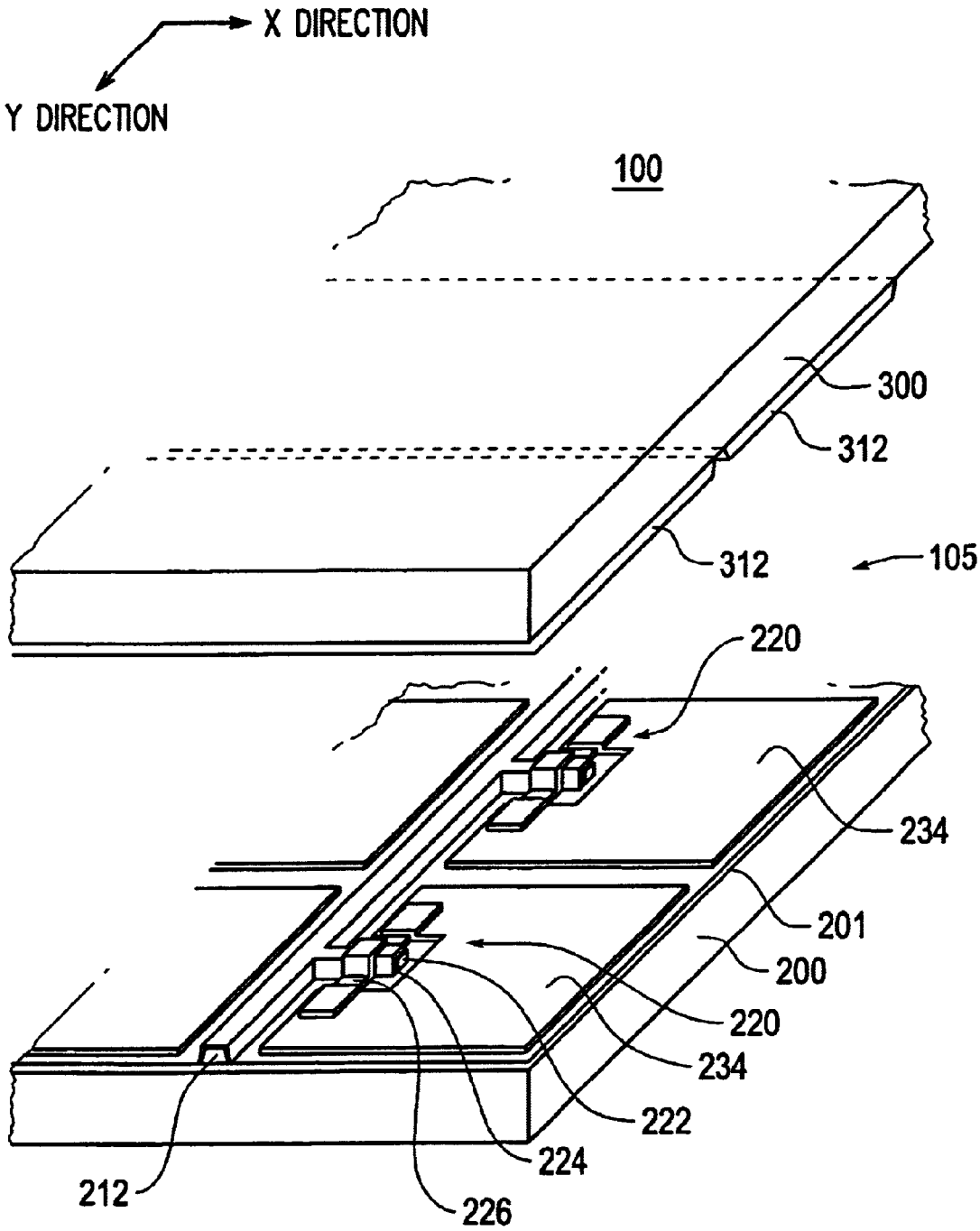
FIG. 3 is a fragmentary perspective view illustrating the structure of a main part of the liquid crystal panel.

The detailed structure of pixels 116 of the liquid crystal panel 100 is described below. FIG. 3 is a fragmentary perspective view illustrating some pixels. As shown in FIG. 3, pixel electrodes 234 formed of a transparent conducting material, such as ITO (Indium Tin Oxide), are disposed in the form of a matrix on the surface, facing the opposite substrate, of the device substrate 200. Of these pixel electrodes 234, 240 pixel electrodes 234 arranged in the same single column are connected via corresponding TFDs 220 to one of data lines 212 extending in a Y direction. Each TFD 220 is formed so as to have a sandwich structure of conductor/insulator/conductor using a first conductor 222 which is formed of tantalum in the form of elementary substance or an tantalum alloy and which extends as a branch from one of the data lines 212, an insulator 224 obtained by anodizing the first conductor 222, and a second conductor 226, thus chromium such that the TFD 220 has a diode switching characteristic having nonlinearity in current-voltage characteristic in both forward and reverse directions.

An insulating film 201, which is transparent and electrically insulating, is formed on the upper surface of the device substrate 200. This insulating film 201 serves to prevent the first conductor 222 from being peeling off during a heat treatment performed after deposition of the second conductor 226 and also serves to prevent an impurity from diffusing into the first conductor during the heat treatment. When no problem associated with the peeling off and the diffusion occurs, the insulating film 201 may be eliminated.

On the surface, facing the device substrate, of the opposite substrate 300, scanning lines 312 formed of ITO or the like extend in a row direction perpendicular to the direction in which the data lines 212 extends, wherein the scanning lines 312 are disposed at locations corresponding to the pixel electrodes 234 so that the scanning lines 312 serve as opposite electrodes opposing the pixel electrodes 234.

The device substrate 200 and the opposite substrate 300 are spaced a predetermined distance from each other by a sealing material (not shown) coated on the substrates in a peripheral region and also by spacers (not shown) properly distributed. A liquid crystal 105 of, for example, the TN (Twisted Nematic) type is disposed and sealed in a closed space between the device substrate 200 and the opposite substrate 300. Thus, each liquid crystal layer 118 shown in FIG. 1 at a location where a data line 212 and a scanning line 312 cross each other is formed of the scanning line 312, a pixel electrode 234, and a corresponding part of the liquid crystal 105 disposed between the scanning line 312 and the pixel electrode 234.

Furthermore, although not shown in the figure, depending upon an application in which the liquid crystal panel 100 is used, color filters are disposed in the form of stripes, a mosaic, or triangles on the opposite substrate 300. The other areas are covered with a black matrix for blocking light. Furthermore, alignment films rubbed in particular directions are disposed on the mutually-facing surfaces of the device substrate 200 and the opposite substrate 300, respectively, and polarizers or the like corresponding to the alignment directions are disposed on the back faces of the respective substrates.

Figure 12A:
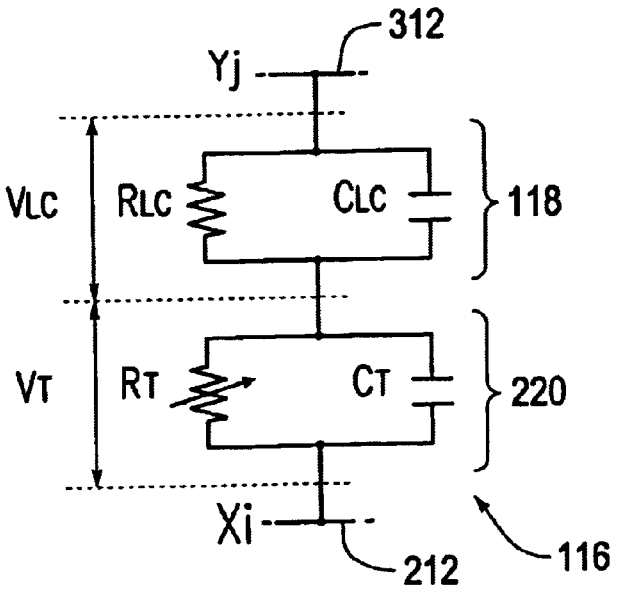
FIGS. 12(*a*) and 12(*b*) are equivalent circuit diagrams of a pixel of a display device according to an embodiment.
Figure 12B:
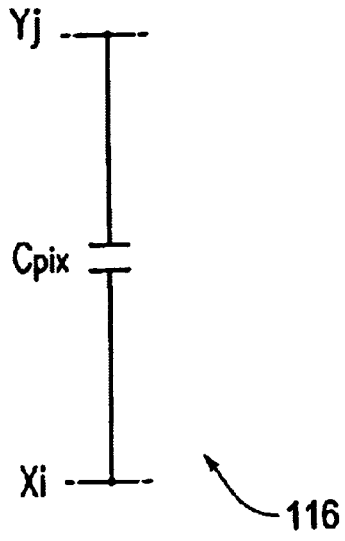

One pixel 116 having the above-described structure can be represented by an equivalent circuit, such as that shown in FIG. 12(*a*). In FIG. 12(*a*), one pixel 116 is represented by a series circuit of a TFD 220 and a liquid crystal layer 118, wherein the TFD 220 is represented by a parallel circuit of a resistor RT and a capacitor CT and the liquid crystal layer 118 is represented by a parallel circuit of a resistor RLC and a capacitor CLC.

A data signal Xi and a scanning signal Yj are applied, by means of a predetermined driving method, to respective two ends of the pixel 116 represented by the above equivalent circuit. Herein, the data signal Xi is assumed to be a data signal applied to a data line 212 of the ith column as counted from the leftmost column in FIG. 1, and the scanning signal Yj is assumed to be a scanning signal applied to a scanning line 312 of thejth row as counted from the top row in FIG. 1.

Figure 13:
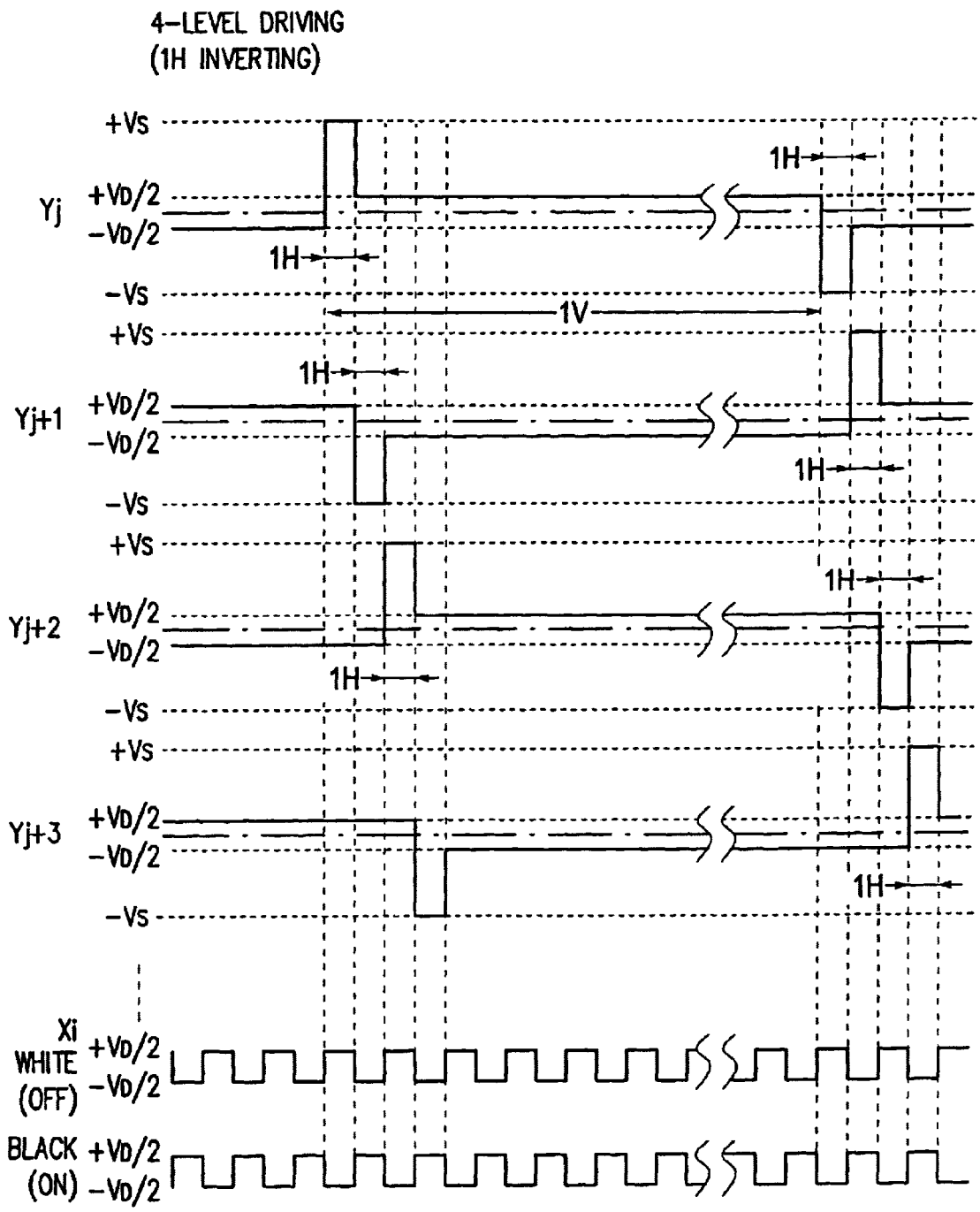
FIG. 13 is a diagram illustrating examples of waveforms of a scanning signal Yj and a data signal Xi according to a 4-value driving (inverting every 1H) method.

A 4-value driving method (inverting every 1H) is widely used as a driving method. FIG. 13 illustrates examples of waveforms of the scanning signal Yj and the data signal Xi which are applied to a certain pixel 116 in accordance with the 4-value driving method. In this driving method, a selection voltage +VS is first applied as the scanning signal Yj during one horizontal scanning period 1H, and then, during a following retention period, a non-selection voltage +VD/2 is applied. If one vertical scanning period (one frame period) 1V has elapsed since the previous selection, a selection voltage −VS is applied. In a following retention period, a non-selection voltage −VD/2 is applied. While performing the above operation repeatedly, either a data voltage +VD/2 or −VD/2 is applied as the data signal Xi. If a selection voltage +VS is applied as the scanning signal Yj to a certain scanning line, a selection voltage −VS is applied as the scanning signal Yj+1 to the subsequent scanning line. In this 4-value driving method (inverting every 1H), in the case +VS is applied as the selection voltage +VS, where a pixel 116 is turned on (to provide a black display ), −VD/2 is applied as the data signal. On the other hand, to turn off the pixel 116 (to provide a white display), +VD/2 is applied as the data signal. In the case where −VS is applied as the selection voltage, when black is displayed by a pixel 116, +VD/2 is applied as the data signal, while −VD/2 is applied when white is displayed by the pixel 116.

Figure 14:
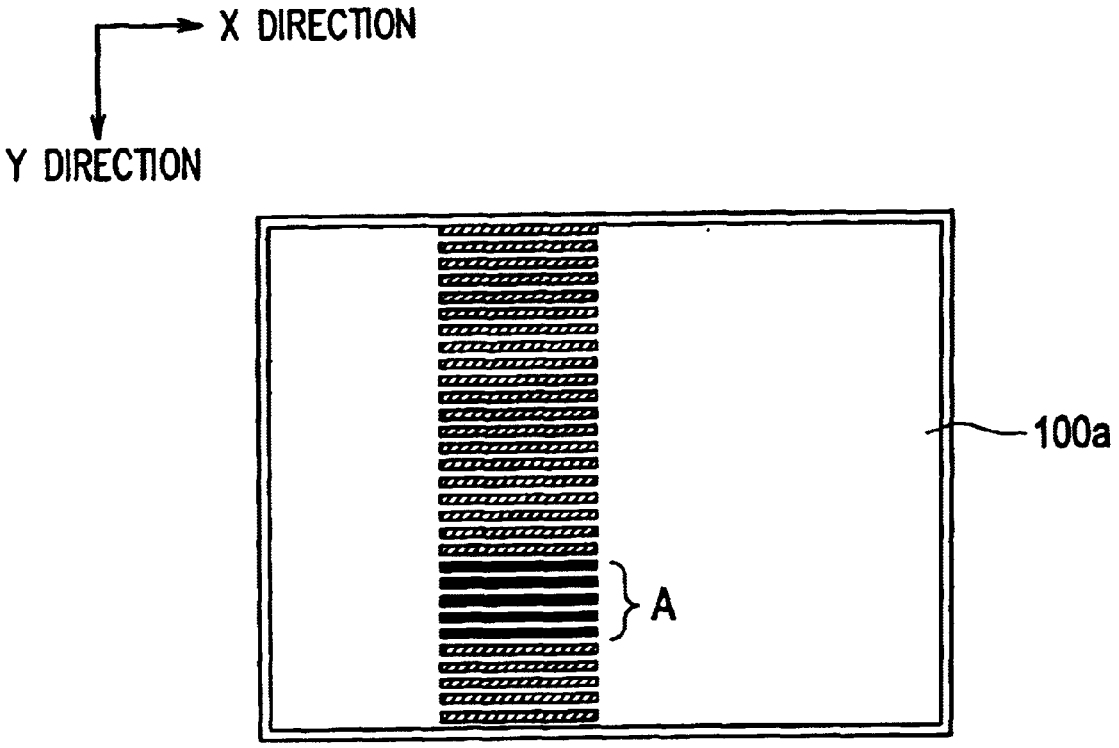
FIG. 14 is a diagram illustrating a problem in a displaying operation.
Figure 15:
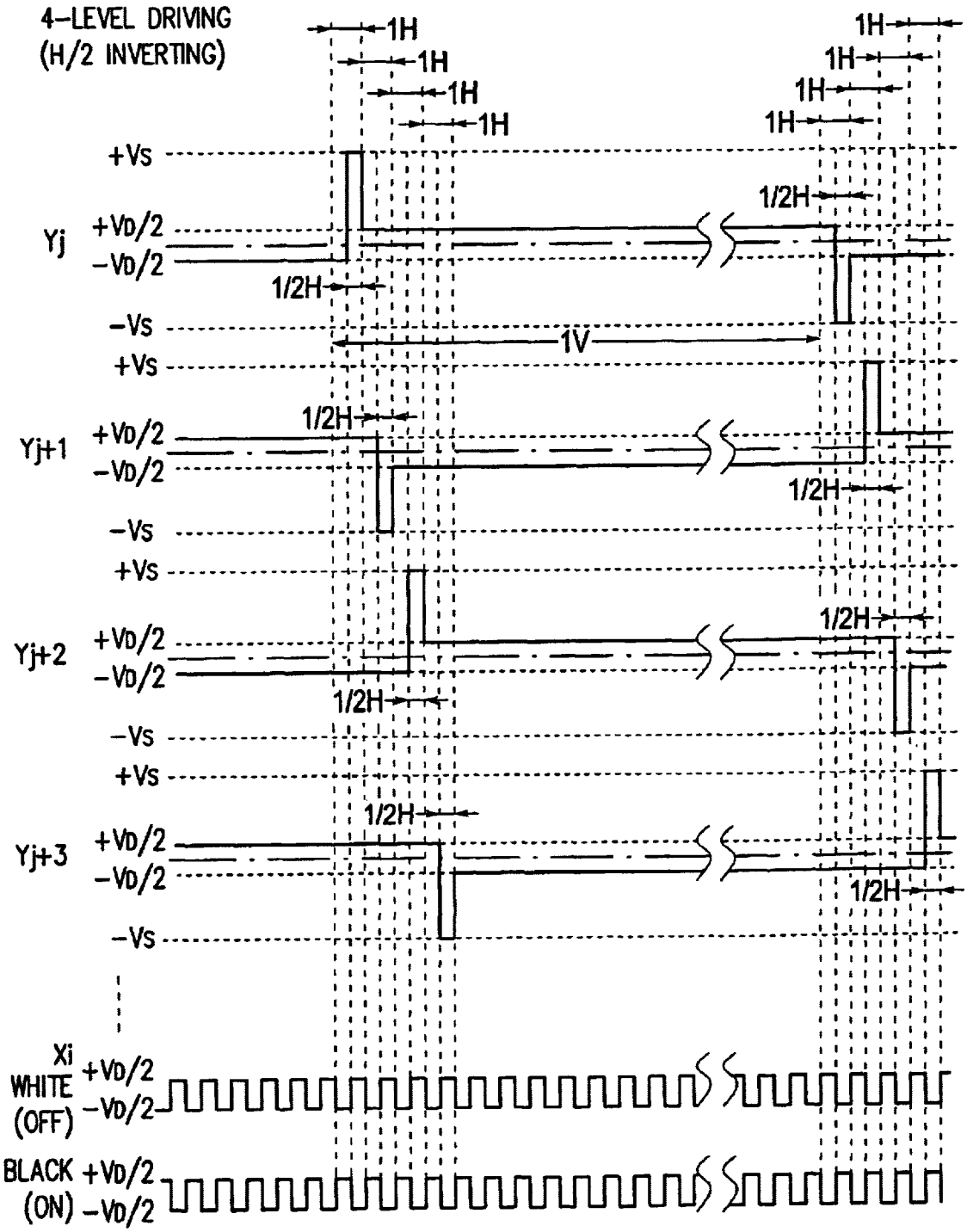
FIG. 15 is a diagram illustrating examples of waveforms of a scanning signal Yj and a data signal Xi according to a 4-value driving (inverting every ½H) method.

In this 4-value driving method (inverting every 1H), if a pattern is displayed in a partial area A of a screen 100*a* such that black and white are alternately displayed from one scanning line to next as shown in FIG. 14, crosstalk occurs in this area A in the Y direction.

The reason is briefly described below. When the above pattern is displayed in the area A, the data signals applied to the data line in this area are periodically switched between ±VD/2 at the same intervals as the scanning signals are inverted, and thus the voltages of the data signals are fixed to either +VD/2 or −VD/2 over a period during which selection lines in the area A are selected. When viewed along pixels in the Y direction in the area A, the data voltages are fixed to either +VD/2 or −VD/2 during a particular part of a retention period. On the other hand, as described earlier, the selection voltages applied to adjacent scanning lines are opposite in polarity. Therefore, in areas adjacent to the area A in the Y direction, differences occur in the effective values of the voltage applied during the part of the retention period between pixels 116 in odd-numbered rows and those in even-numbered rows. As a result, in the areas adjacent to the area A in the Y direction, differences occur in the gray levels between the pixels 116 in odd-numbered rows and those in even-numbered rows, and thus crosstalk occurs.

One technique of preventing the above problem is to employ a 4-value driving (inverting every ½H) method. Each horizontal scanning period 1H in the 4-value driving (inverting every 1H) method is divided into a first and second half periods. A scanning line is selected, for example, during each first half period (½H), and data voltages −VD/2 and +VD/2 are respectively applied during periods of 50% of the one total horizontal scanning period 1H. According to the 4-value driving (inverting every ½H) method, even when any pattern is displayed, the data signal Xi has a voltage equal to −VD/2 during a half period of a horizontal scanning period and has a voltage equal to +VD/2 during the other half period, and thus no crosstalk occurs.

A driving method for obtaining a gray-scale image is described below. Two known methods of displaying a gray-scale image are voltage modulation and pulse width modulation. In the voltage modulation, controlling a voltage so as to obtain a desired gray level is difficult. For this reason, the pulse width modulation is more widely used. The pulse width modulation may be applied to the 4-value driving (inverting every ½H) method in three different manners. In a first manner called right-side modulation, a turn-on voltage is applied during a period immediately before the end of a selection period as shown in FIG. 16(*a*).

Figure 16A:
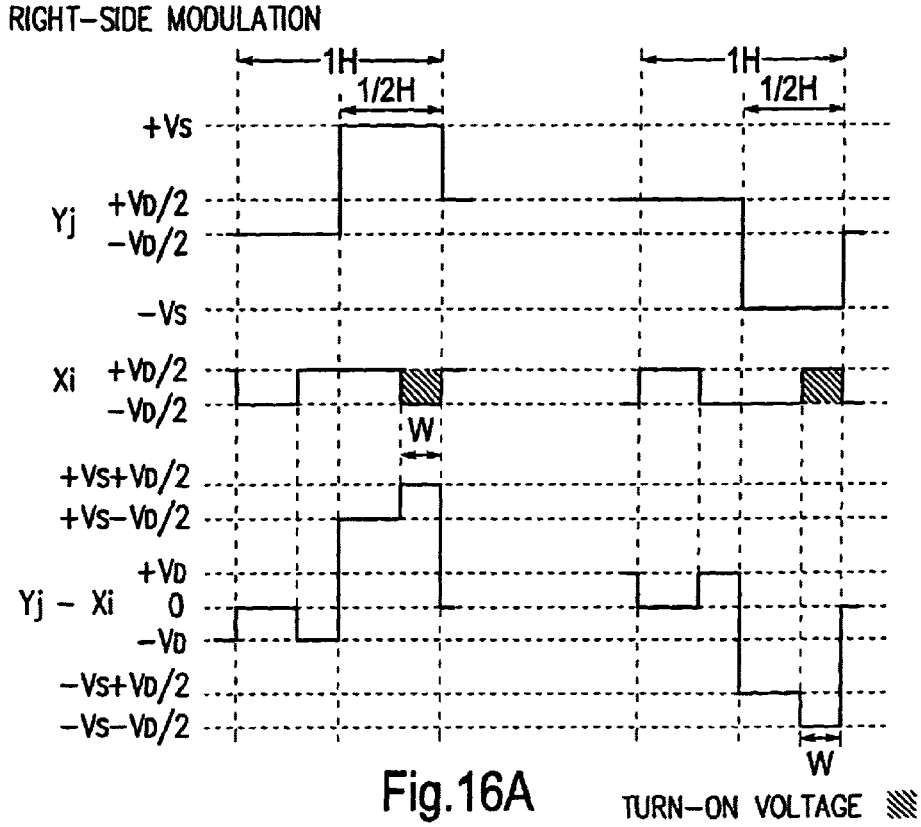
FIG. 16(*a*) is a diagram illustrating a right-side modulation method, and FIG. 16(*b*) is a diagram illustrating a left-side modulation method.
Figure 16B:
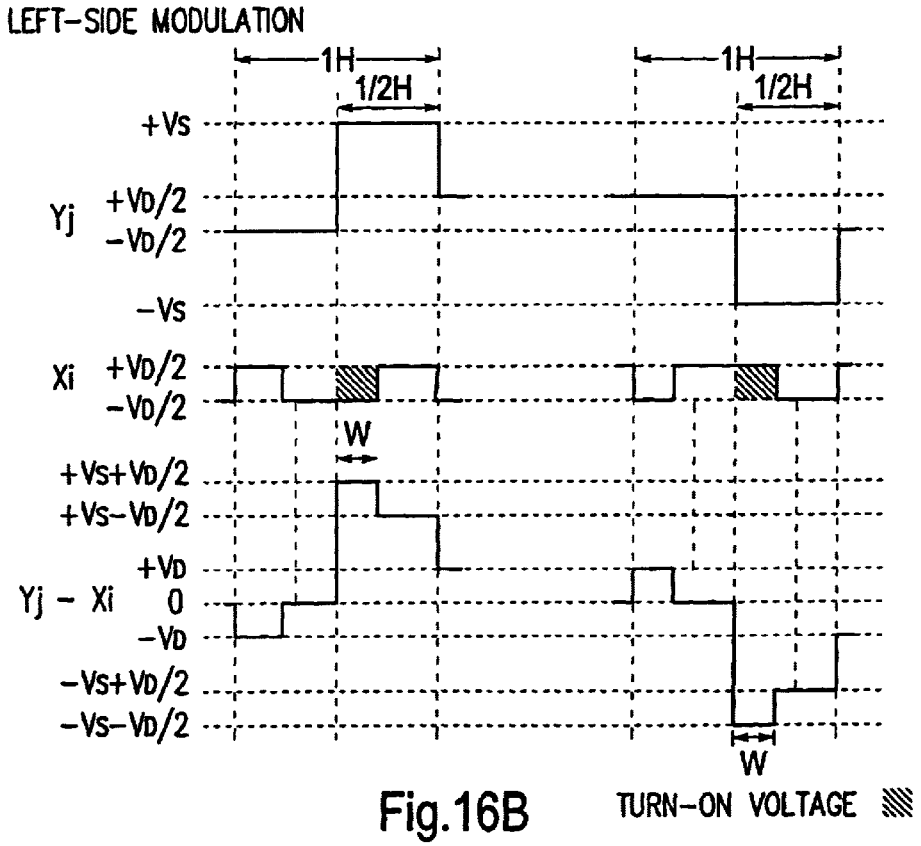

In a second manner called left-side modulation, a turn-on voltage is applied during a period at the start of a selection period as shown in FIG. 16(*b*).

In a third manner called distributed modulation (not shown), turn-on voltages with time widths corresponding to weights of respective bits of gray-level data are distributed during a selection period. Herein, the turn-on voltage refers to a voltage of a data signal Xi which is applied to a data line 212 of ith column to write data into a pixel 116, wherein the turn-on voltage has an opposite polarity to that of a selection voltage ±V<SUB>S</SUB>[±VS] during a period in which the selection voltage is applied.

Of the three modulation methods, the left-side modulation and the distributed modulation have a problem that discharging occurs after a turn-on voltage is written, and thus it is difficult to obtain precise gray levels. Besides, a high driving voltage is needed in these methods. For the above reason, when a gray-scale image is displayed using the 4-value driving method, the right-side modulation is usually employed. Therefore, it is assumed that the right-side modulation is used in the following description, although the present invention may also be applied to the left-side modulation.

In the display device shown in FIG. 1, because there are a total of 240 scanning lines 312, a retention period (non-selection period) in one vertical scanning period 1V is equal to 239 times one horizontal scanning period 1H, that is, 239H. In each retention period, the TFD 220 is turned off, and thus the resistance RT of the TFD 220 becomes very large. On the other hand, the resistance RLC of the liquid crystal layer 118 is very large regardless of whether TFD 220 is in an on-state or off-state. Therefore, in the retention period, the equivalent circuit of the pixel 116 can be represented by a capacitor Cpix equivalent to a series of capacitors CT and CLC as shown in FIG. 12(*b*). Herein, the capacitance Cpix is equal to (CT·CLC)/(CT+CLC).

Figure 17A:
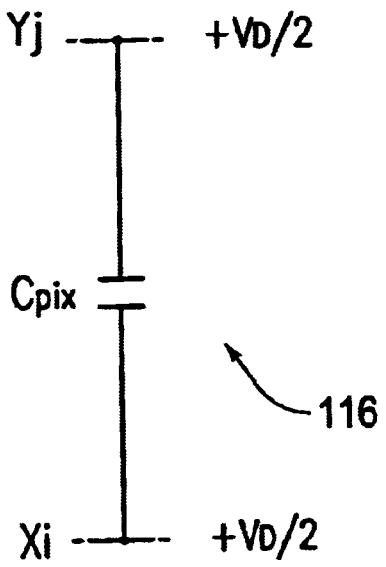
FIGS. 17(*a*) and 17(*b*) are diagrams illustrating power consumption in switching of the voltage of a data signal Xi during a retention period.
Figure 17B:
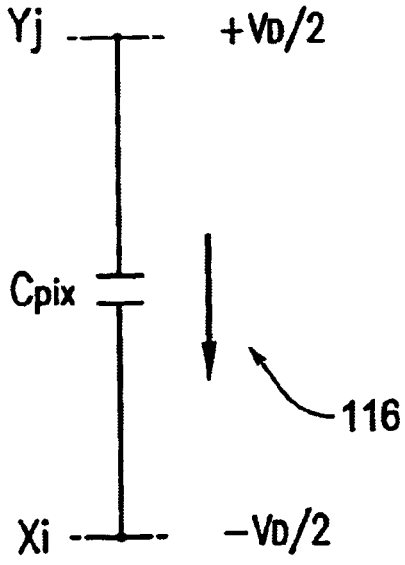

When a certain scanning line 312 is in a non-selected state and a non-selection signal having a voltage of +VD/2 is applied as the scanning signal Yj to that scanning line 312, the data voltage of the data signal Xi is alternately switched to +VD/2 or −VD/2, as shown in FIG. 17(*a*) or 17(*b*). Although not shown in the figure, when a non-selection voltage having a voltage of −VD/2 is applied as the scanning signal Yj to that scanning line, the data voltage of the data signal Xi is also switched alternately to +VD/2 or −VD/2. Therefore, in one pixel 116, even in a retention (non-selection) period, a charge equal to Cpix·VD is supplied from a power supply when the voltage of the data signal Xi is switched twice, and thus power is consumed by a capacitive load of the pixel 116.

Figure 18:
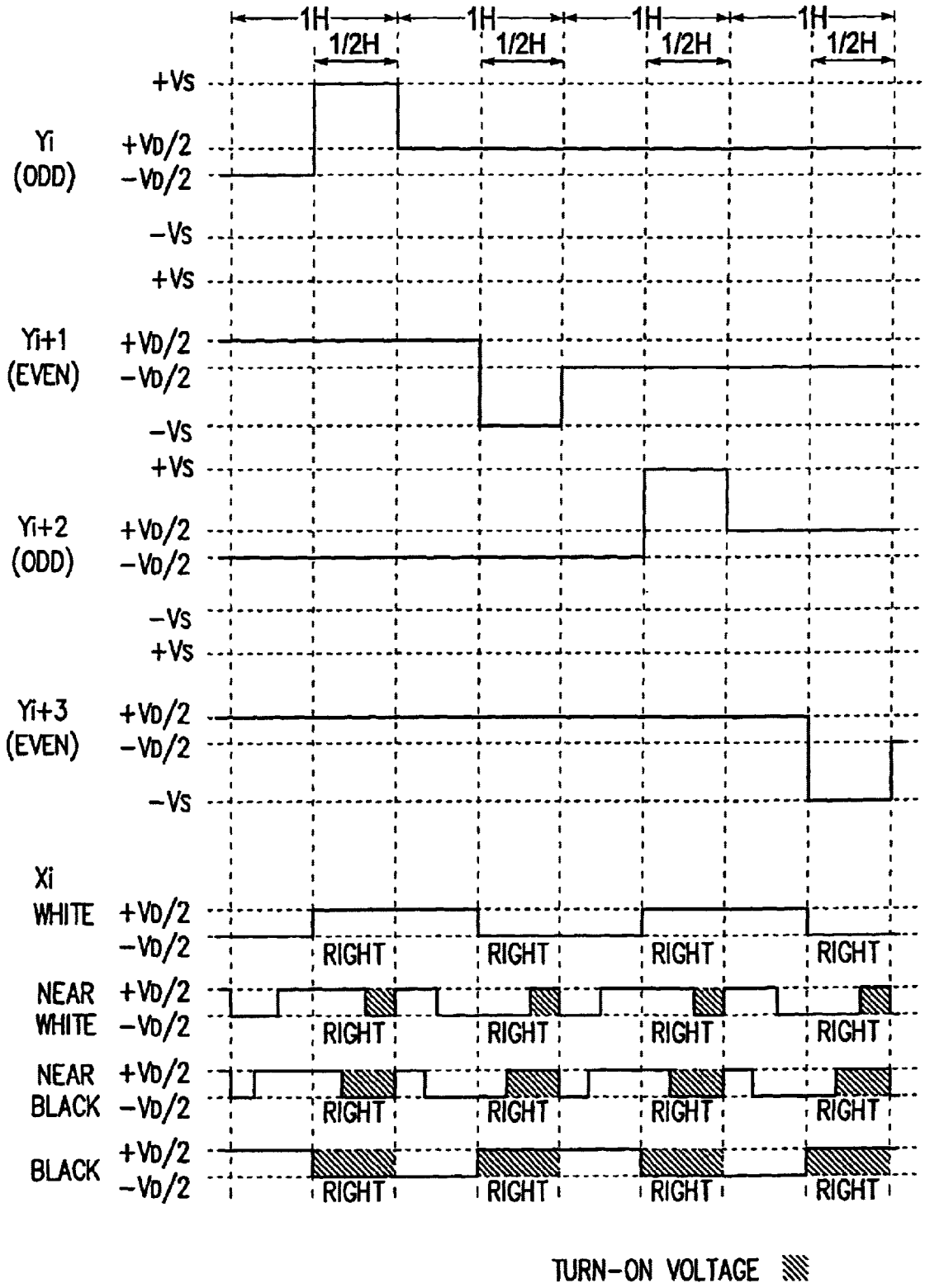
FIG. 18 is a diagram illustrating examples of waveforms of a scanning signal Yj and a data signal Xi according to the right-side modulation method.

In the case where the right-side modulation is used to display a gray-scale image using the 4-value driving method, when pixels 116 in one column corresponding to a certain data line 212 are white (off) or black (on), the voltage of the data signal Xi for this data line 212 is switched once during one horizontal period 1H as shown in FIG. 18. However, when intermediate gray levels (for example, near white or near black ) are displayed at pixels 116 in a certain column, the voltage of the data signal Xi for this column is switched three times during one horizontal period 1H as shown in FIG. 16. Therefore, when a certain pixel 116 is at an intermediate gray level, electric power consumed in the retention period becomes three times greater than that consumed when the pixel 116 is white or black .

Figure 5:
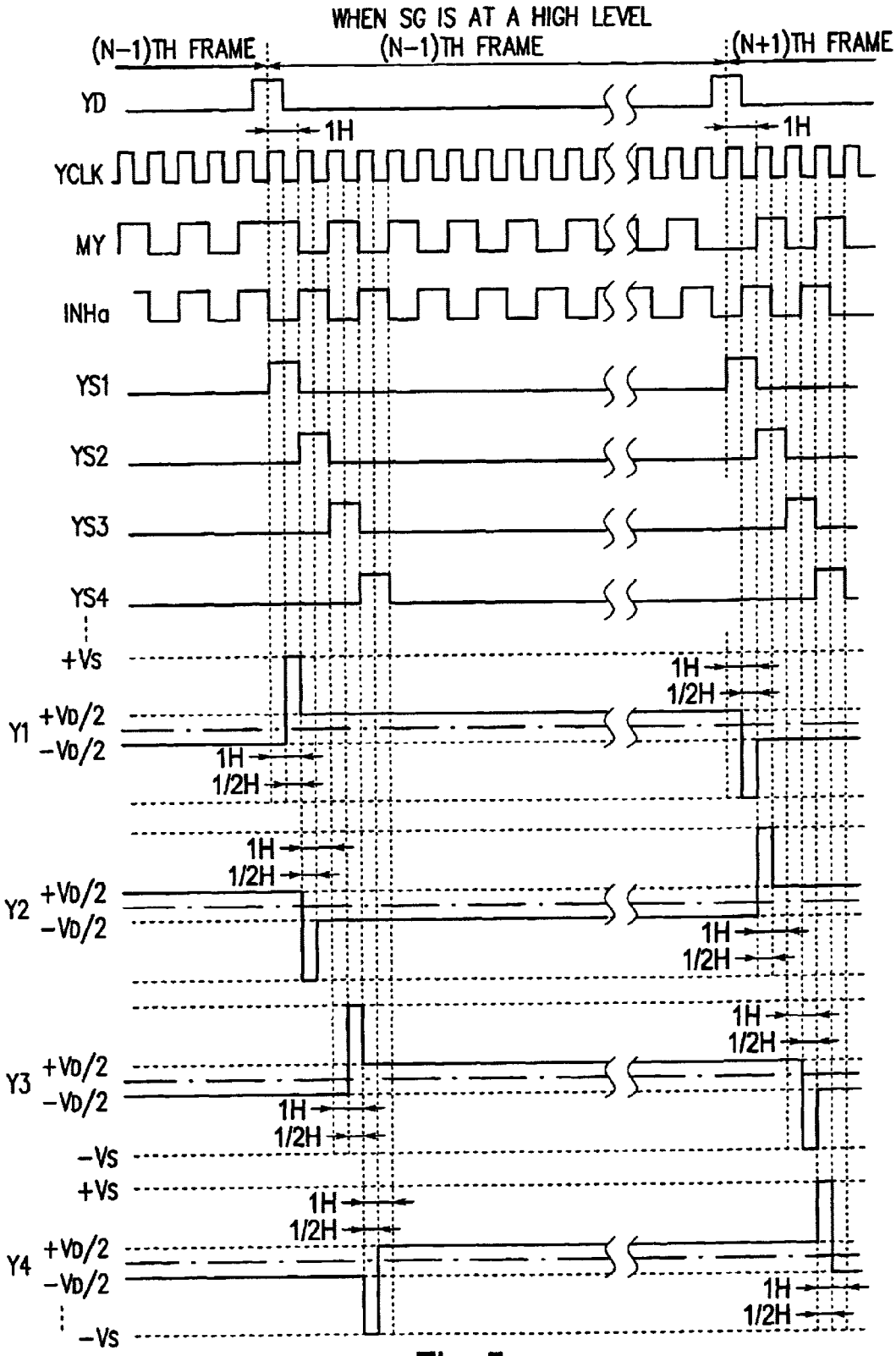
FIG. 5 is a timing chart illustrating an operation of the Y driver.
Figure 8:
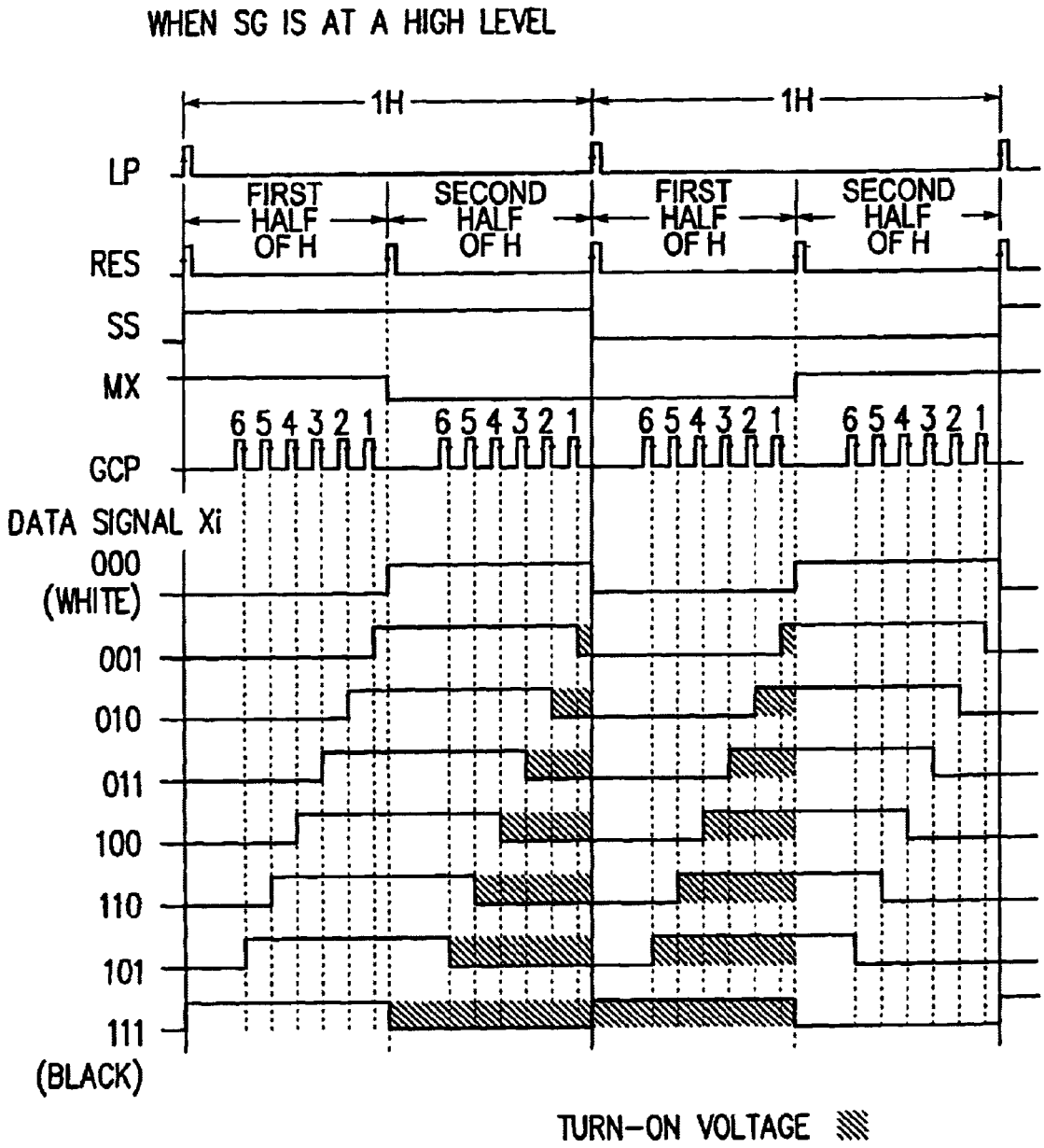
FIG. 8 is a timing chart illustrating an operation of the X driver.
Figure 10:
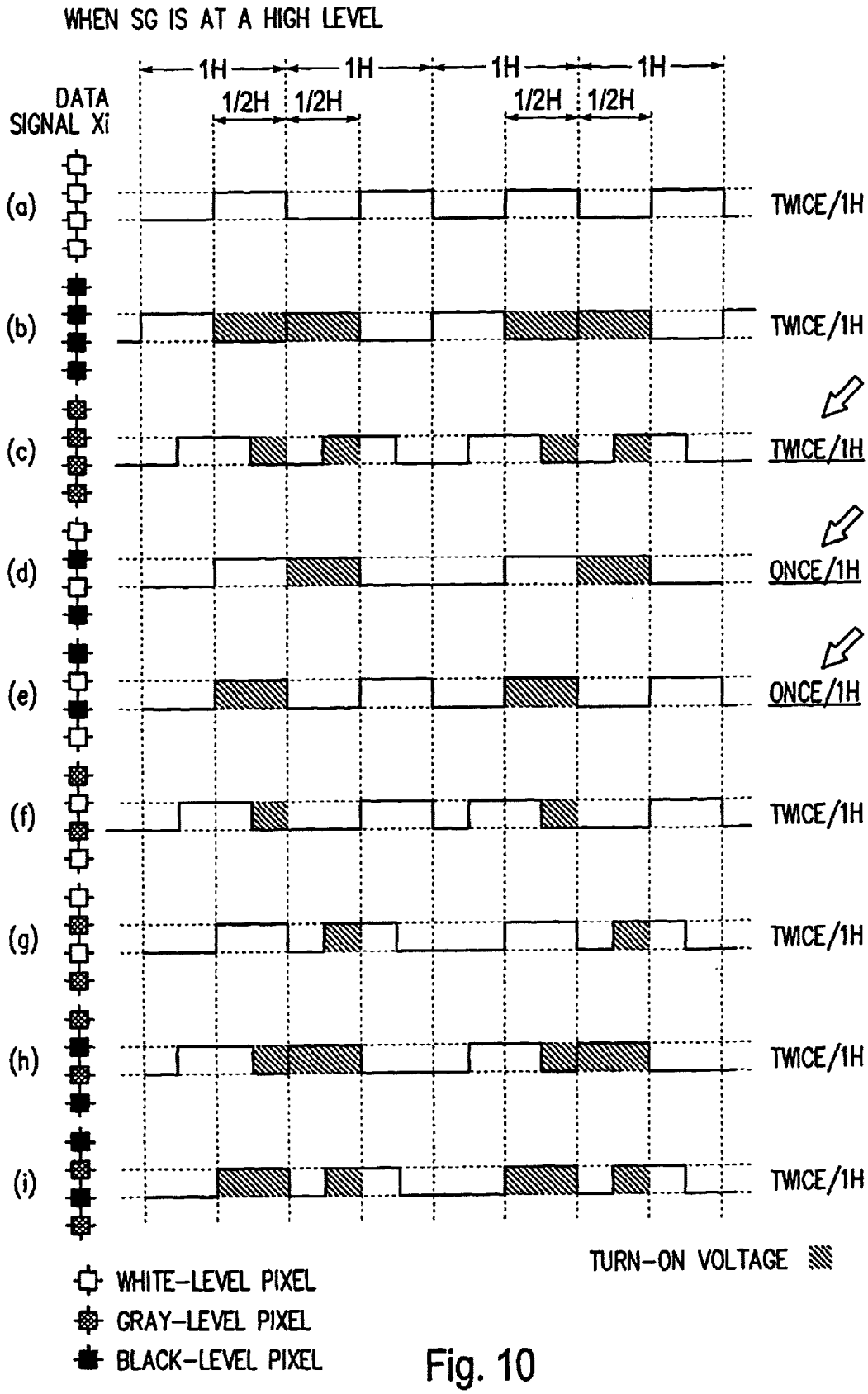
FIG. 10 is a timing chart illustrating voltage waveforms of a data signal Xi for various combinations of gray levels for the case in which a discrimination signal SG is at a high level.

In the display device according to the present embodiment of the invention, to prevent the above problem, as shown in FIG. 5, either of +V<SUB>S</SUB> or −V<SUB>S</SUB>[+VS or −VS] is applied as the selection voltage to a scanning line 312 in an odd-numbered row during the second half period of one horizontal scanning period, while either of +V<SUB>S</SUB> or −V<SUB>S</SUB>[+VS or −VS] is applied as the selection voltage to a scanning line 312 in an even-numbered row during the first half period of one horizontal scanning period, so that the voltage of the data signal Xi applied to a pixel to display an intermediate gray level is switched twice during one horizontal period 1H as shown in FIG. 8 or FIG. 10(*c*) thereby suppressing power consumption during the retention period. A circuit used to perform such a driving operation is described below.

Figure 6:
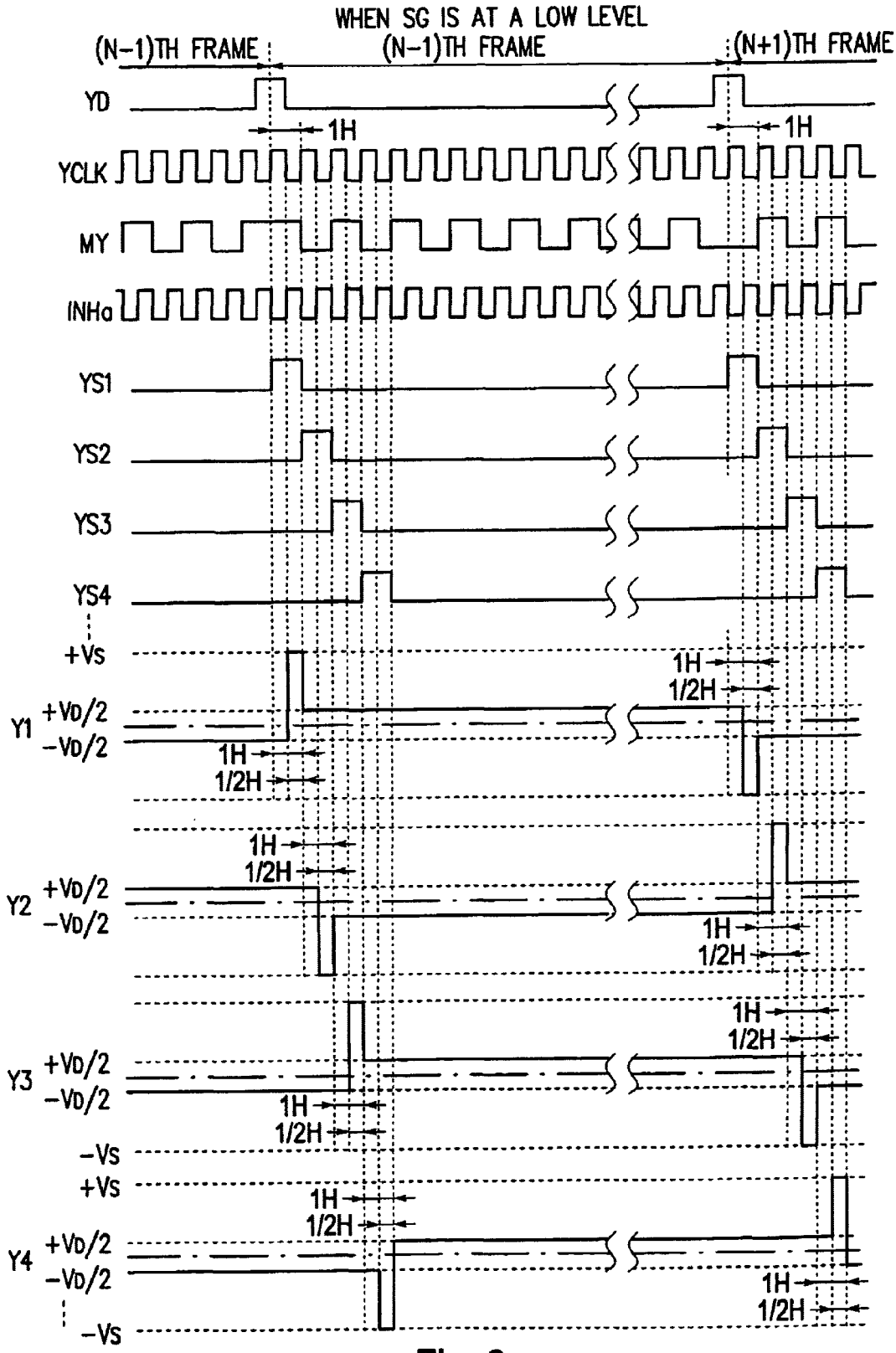
FIG. 6 is a timing chart illustrating an operation of the Y driver.

First, various control signals such a clock signal and other control signals generated by the control circuit 400 are described. A start pulse YD is generated at the beginning of each vertical scanning period (each frame period) as shown in FIG. 5 or 6. A clock signal YCLK is a reference signal associated with the scanning lines. As shown in FIG. 5 or 6, the clock signal YCLK has a period equal to one horizontal scanning period 1H.

An AC driving signal MY is a signal for controlling the pixels 116 to be driven via the scanning lines in an AC fashion. As shown in FIG. 5 or 6, the signal level of the AC driving signal MY is inverted every horizontal scanning period 1H, and furthermore, during the horizontal scanning period in which the same scanning line is selected, the signal level associated with the same scanning line is inverted every vertical scanning period.

Either one of control signals INHa and INHb is used in an exclusive fashion depending upon the level of the discrimination signal SG to specify a period in a horizontal scanning period during which a selection voltage is to be applied. The control signal INHa is used when the level of the discrimination signal SG is high.

As shown in FIG. 5, the control signal NHa has a period twice the period of the clock signal YCLK, and becomes high in the second half period ½H of a horizontal scanning period during which a scanning line 312 in an odd-numbered row is selected and also in the first half period ½H of a horizontal scanning period during which a scanning line 312 in an even-numbered row is selected. On the other hand, the control signal INHa is used when the level of the discrimination signal SG is low.

As shown in FIG. 6, the control signal NHb has a period equal to the period of the clock signal YCLK, and becomes high in the second half period ½H of a horizontal scanning period during which a scanning line 312 in an odd-numbered row is selected and also in the second half period ½H of a horizontal scanning period during which a scanning line 312 in an even-numbered row is selected.

Figure 9:
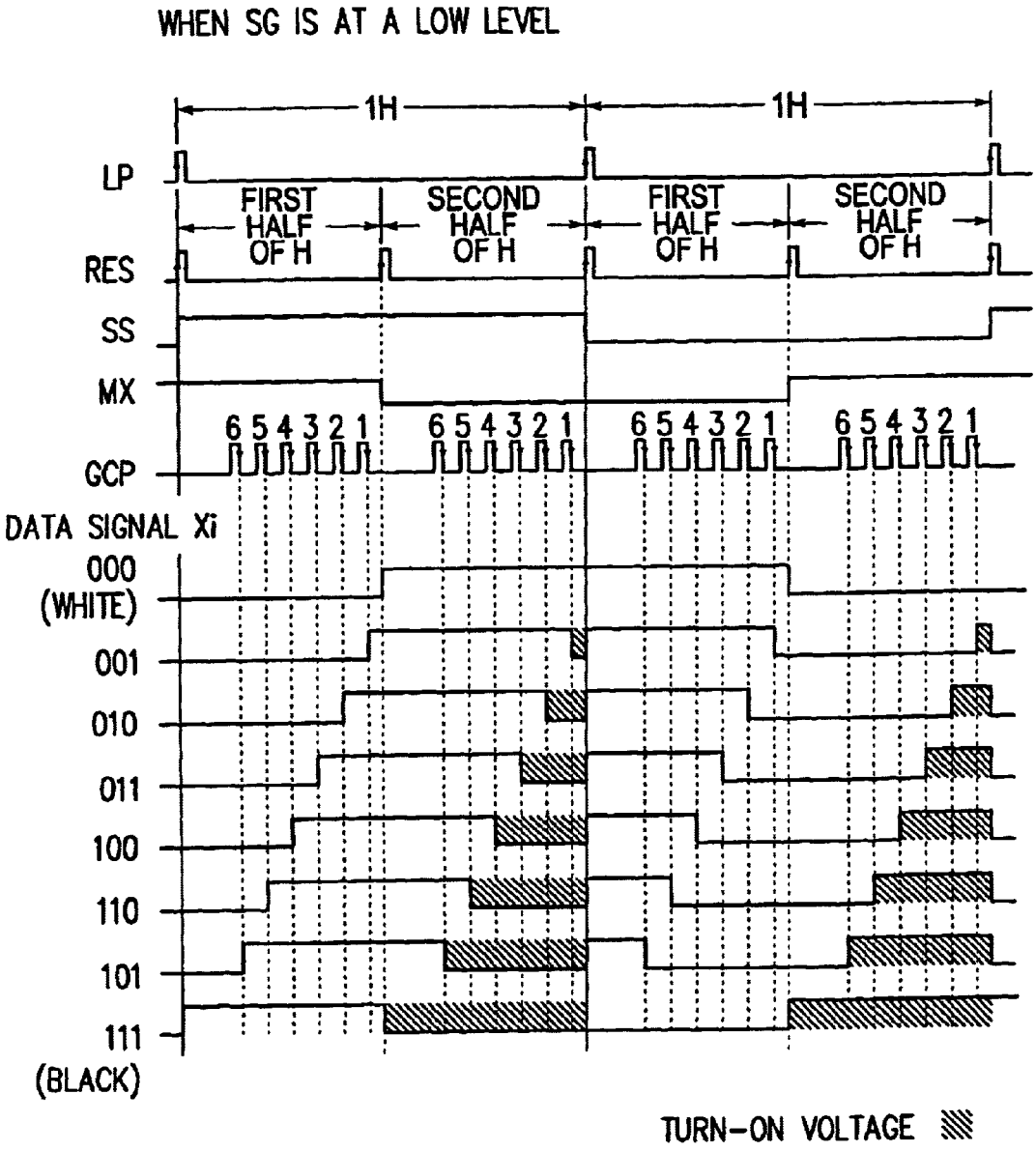
FIG. 9 is a timing chart illustrating an operation of the X driver.

A latch pulse LP is generated to latch a data signal on the data line side. As shown in FIG. 8 or 9, a latch pulse LP is generated at the beginning of each horizontal scanning period 1H. A reset signal RES is generated at the beginning of a first half period and at the beginning of a second half period of each horizontal scanning period 1H as shown in FIG. 8 or 9. As shown in FIG. 8 or 9, an odd/even signal SS becomes high during a horizontal scanning period during which a scanning line 312 in an odd-numbered row is selected, while the odd/even signal SS becomes low during a horizontal scanning period during which a scanning line 312 in an even-numbered row is selected. An AC driving signal MX is a signal for controlling the pixels 116 to be driven via the data lines in an AC fashion. As shown in FIG. 8 or 9, the AC driving signal MX is maintained at an equal signal level during the second half of each horizontal scanning period 1H and the first half of the immediately following horizontal scanning period 1H. At the end of the first half of each horizontal scanning period, the signal level is inverted. The AC driving signals MX and MY are opposite in polarity to each other during the second half of each horizontal scanning period.

Gray level code pulses GCP are placed, as shown in FIG. 8 or 9, immediately before the end of each of the first and second half periods of each horizontal scanning period 1H, such that the pulse positions relative to the end of each half period correspond to the intermediate gray level. In the present embodiment, if gray level data for specifying the intensity of a pixel is represented by 3 bits so as to indicate one of 8 gray levels, and if (000) indicates white (off) and (111) indicates black (on), gray level code pulses GCP are placed in each of the first and second half periods such that six pulses corresponding to intermediate gray levels (001) to (110) other than black and white are placed. More specifically, in FIG. 8 or 9, (001), (010), (011), (100), (101), and (110) of gray level data corresponds to "1", "2", "3", "4", "5", and "6" of gray level code pulses. Although in FIGS. 8 and 9 the gray level code pulses GCP are placed at equal intervals for simplicity of illustration, the intervals generally vary depending upon the voltage-intensity (V-I) characteristic of pixels.

Figure 4:
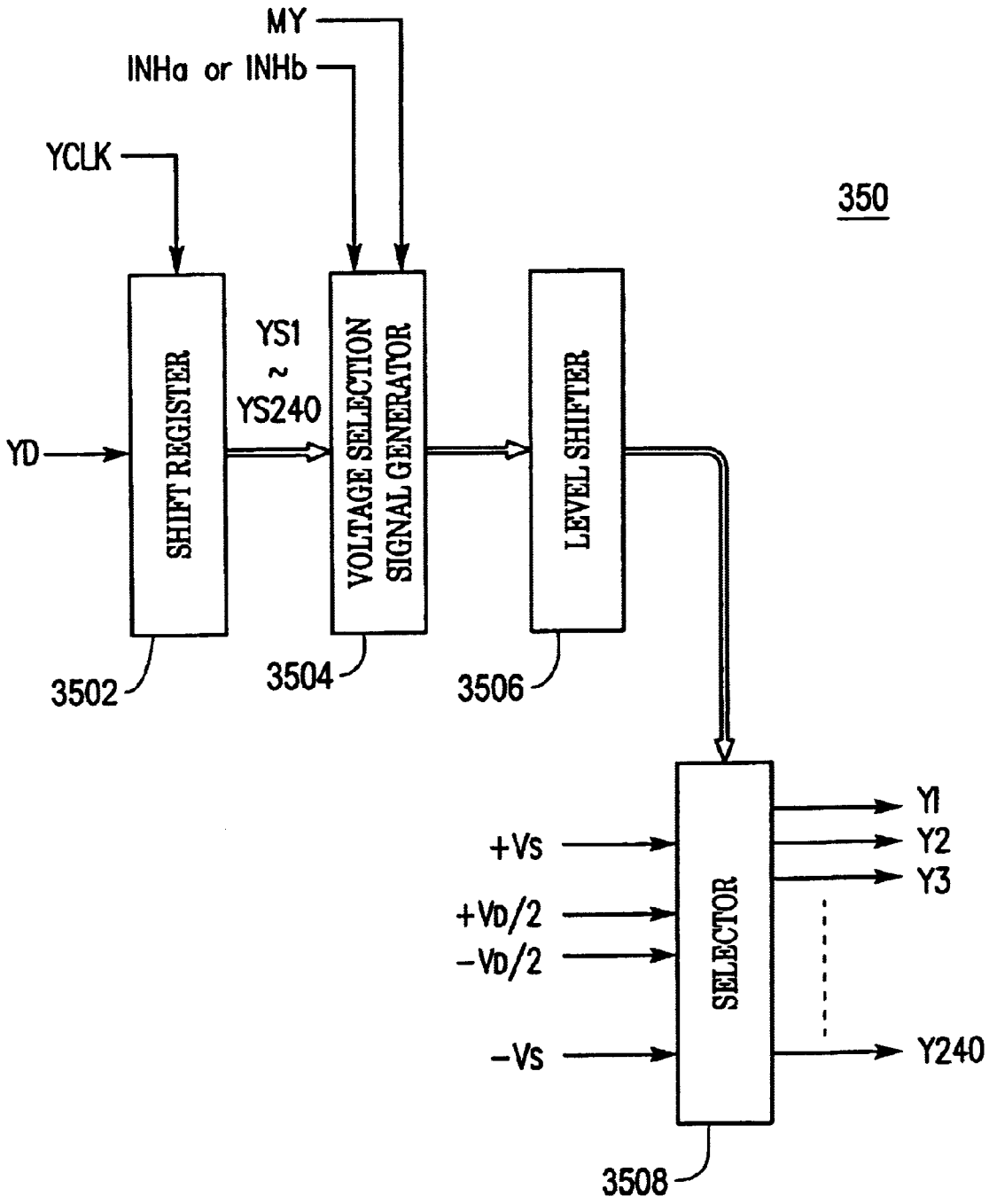
FIG. 4 is a block diagram illustrating the structure of a Y driver of the display device.

The details of the scanning line driver circuit 350 are described. FIG. 4 is an exemplary block diagram illustrating the structure of the scanning line driver circuit 350. In FIG. 4, a shift register 3502 is a 240-bit shift register having a register size corresponding to the total number of scanning lines 312. A start pulse YD is supplied to the shift register 3502 at the beginning of each frame. The shift register 3502 shifts the received start pulse YD in response to a clock signal YCLK having the same period as the horizontal scanning period 1H, and outputs transferred signals YS1, YS2, . . . , YS240 such that one signal is output at a time. The transferred signals YS1, YS2, . . . , YS240 correspond in a one-to-one fashion to the 1st, 2nd, . . . , and 240th scanning lines 312, respectively. When a transferred signal is at a high level, a corresponding scanning line 312 is selected.

A voltage selection signal generator 3504 generates, from the AC driving signal MY and the control signal INHa or INHb, a voltage selection signal which determines a voltage to be applied to a scanning line 312. In the present embodiment, as described earlier, the voltage of the scanning signal to be applied to a scanning line 312 is equal to one of four values: +VS (positive selection voltage), +VD/2 (positive non-selection voltage), −VS (negative non-selection voltage), and −VD/2 (negative selection voltage). Of these voltages, the selection voltage +VS or −VS is applied during the first or second half period ½H of a horizontal scanning period. If a selection voltage +VS is applied in the certain second half of a certain horizontal scanning period, the following non-selection voltage has a level equal to +VD/2. Conversely, when −VS is applied as a selection voltage, the following non-selection voltage has a level equal to −VD/2. That is, the level of the non-selection voltage is uniquely determined by the previous selection voltage.

To this end, the voltage selection signal generator 3504 generates 240 voltage selection signals such that the voltage levels of the scanning signals Y1, Y2, . . . , Y240 satisfy the following conditions. That is, when one of transferred signals YS1, YS2, . . . , YS240 becomes high and a corresponding scanning line 312 is selected, the voltage selection signal generator 3504 generates voltage selection signals so that the voltage level of the scanning signal applied to that scanning line 312 becomes equal to a selection voltage corresponding to the AC driving signal MY during a period in which the control signal INHa or INHb is at a high level, and so that in response to a high-to-low transition of the control signal INHa or INHb, the voltage level of the scanning signal is changed to a non-selection voltage determined depending upon the previous selection voltage. More specifically, if the AC driving signal MY is high during a period in which the control signal INHa or INHb is active, the voltage selection signal generator 3504 outputs a voltage selection signal which causes the positive selection voltage +VS to be selected and then outputs a voltage selection signal which causes the positive non-selection voltage +VD/2 to be selected. On the other hand, if the AC driving signal MY is low during a period in which the control signal INHa or INHb is active, the voltage selection signal generator 3504 outputs a voltage selection signal which causes the negative selection voltage −VS to be selected and then outputs a voltage selection signal which causes the negative non-selection voltage −VD/2 to be selected. The voltage selection signal generator 3504 generates a voltage selection signal in a similar manner for each of 240 signal lines 312.

A level shifter 3506 expands the amplitude of the voltage of the voltage selection signal output from the voltage selection signal generator 3504. A selector 3508 selects a voltage specified by the voltage selection signal having an expanded amplitude and supplies the selected voltage to a corresponding scanning line 312.

The waveform of the scanning signal supplied from the scanning line driver circuit 350 having the above structure is described below with reference to FIGS. 5 and 6. As described above, one of the control signals INHa and INHb is output depending upon the level of the discrimination signal SG. First, the operation is described below for the case where the discrimination signal SG is high and the control signal INHa is output.

In this case, as shown in FIG. 5, when a start pulse YD is supplied at the beginning of a vertical scanning period (one frame period), the start pulse YD is shifted every horizontal scanning period 1H in response to the clock signal YCLK, and the resultant signal is output as transferred signals YS1, YS2, . . . , YS240 one by one. When the control signal INHa is active, scanning lines 312 in the odd-numbered rows are selected during the second half period ½H of one horizontal scanning period and scanning lines 312 in the even-numbered rows are selected during the first half period ½H of one horizontal scanning period, wherein the polarity of the selection voltage is determined depending upon the level of the AC driving signal MY during the half period ½H during which a scanning line of interest is selected.

Thus, the voltage of the scanning signal supplied to a scanning line 312 in an odd-numbered row becomes equal to the positive selection voltage +VS if the AC driving signal MY is high during the second half of the horizontal scanning period and thereafter is changed to the positive non-selection voltage +VD/2 in response to the polarity of the selection voltage and maintained at that voltage. In the second half ½H of a horizontal scanning period one frame after that, the AC driving signal MY is inverted to a low level, and thus the voltage of the scanning signal supplied to that scanning line becomes equal to the negative selection voltage −VS. After the end of that second half period, the voltage of the scanning signal is changed to the negative non-selection voltage −VD/2 in response to the polarity of the previous selection voltage and is maintained at that level. For example, the scanning signal Y1 supplied to a scanning line in the first row as counted from the top has a voltage equal to the positive selection voltage +VS during the second half of the first horizontal scanning period of an nth frame. At the end of that second half period, the voltage is changed to the non-selection voltage +VD/2 and maintain at that level. At the beginning of the second half of the first horizontal period of the following (n-1)th frame, the voltage of the scanning signal is changed to the negative selection voltage −VS. At the end of that second half period, the voltage of the scanning signal is changed to the negative non-selection voltage −VD/2 and maintained at that level. Thereafter, the above cycle is repeated.

Thus, the voltage of the scanning signal supplied to scanning lines 312 in even-numbered rows becomes equal to the negative selection voltage −VS during the second half period ½H of one horizontal scanning period if the AC driving signal MY is low and thereafter is changed to the negative non-selection voltage −VD/2 in response to the polarity of the selection voltage and maintained at that voltage. In the first half period ½H of a horizontal scanning period one frame after that, the AC driving signal MY is inverted to a high level, and thus the voltage of the scanning signal supplied to that scanning line becomes equal to the positive selection voltage +VS. After the end of that first half period, the voltage of the scanning signal is changed to the positive non-selection voltage +VD/2 in response to the polarity of the previous selection voltage and is maintained at that level. For example, the scanning signal Y1 supplied to a scanning line in the second row as counted from the top has a voltage equal to the negative selection voltage −VS during the first half of the second horizontal scanning period of the nth frame. At the end of that first half period, the voltage is changed to the non-selection voltage −VD/2 and maintain at that level. At the beginning of the first half period of the second horizontal period of the following (n+1)th frame, the voltage of the scanning signal is changed to the positive selection voltage +VS and maintained at that level. Thereafter, the above cycle is repeated.

Because the signal level of the AC driving signal MY is inverted every horizontal scanning period 1H, the voltages of the scanning signals applied to adjacent scanning lines become opposite in polarity to each other and are inverted every horizontal scanning period 1H. For example, as shown in FIG. 5, if the scanning signal Y1 applied to the scanning line which is first selected in the nth frame has a voltage equal to the positive selection voltage +VS during the second half of that horizontal scanning period, the scanning voltage Y2 applied to a scanning line which is selected thereafter has a voltage equal to the negative selection voltage −VS during the second half of the horizontal scanning period during which that scanning line is selected.

Now, an exemplary operation is described below for the case where the discrimination signal SG is low and the control signal INHb is supplied. As shown in FIG. 6, the control signal INHb is at an active high level during the second half period ½H of one horizontal scanning period regardless of whether a selected scanning line 312 is in an odd-numbered or even-numbered row. Therefore, when any scanning line 312 is selected, it is selected during the second half period ½H of one horizontal scanning period, wherein the polarity of the selection voltage is determined depending upon the level of the AC driving signal MY during that second half period ½H.

Thus, the voltage of the scanning signal supplied to a scanning line 312 in an odd-numbered row becomes equal to the positive selection voltage +VS if the AC driving signal MY is high during the second half of the horizontal scanning period and thereafter is changed to the positive non-selection voltage +VD/2 in response to the polarity of the selection voltage and maintained at that voltage. In the second half ½H of a horizontal scanning period one frame after that, the AC driving signal MY is inverted to a low level, and thus the voltage of the scanning signal supplied to that scanning line becomes equal to the negative selection voltage −VS. After the end of that second half period, the voltage of the scanning signal is changed to the negative non-selection voltage −VD/2 in response to the polarity of the previous selection voltage and is maintained at that level.

The operation performed when the discrimination signal SG is low is similar to that performed when the discrimination signal SG is high, in that the scanning signal Y1 supplied to a scanning line in, for example, the first row as counted from the top has a voltage equal to the positive selection voltage +VS during the second half of the first horizontal scanning period of an nth frame, and at the end of that second half period, the voltage is changed to the non-selection voltage +VD/2and maintain at that level. Furthermore, at the beginning of the second half of the first horizontal period of the following (n+1)th frame, the voltage of the scanning signal is changed to the negative selection voltage −VS. Then at the end of that second half period, the voltage of the scanning signal is changed to the negative non-selection voltage −VD/2 and maintained at that level, and thereafter, the above cycle is repeated.

However, it is different in that the scanning signal Y2 supplied to a scanning line in the second row as counted from the top has a voltage equal to the positive selection voltage +VS during the second half of the first horizontal scanning period of the nth frame, and at the end of that second half period, the voltage is changed to the non-selection voltage +VD/2 and maintain at that level, and furthermore, at the beginning of the second half of the first horizontal period of the following (n+1)th frame, the voltage of the scanning signal is changed to the negative selection voltage −VS, and then at the end of that second half period, the voltage of the scanning signal is changed to the negative non-selection voltage −VD/2 and maintained at that level, and thereafter, the above cycle is repeated.

In other words, for the scanning lines 312 in the odd-numbered rows, a selection voltage is applied during the second half period ½H of one horizontal scanning period regardless of the level of the discrimination signal SG. However, for the scanning lines 312 in the even-numbered rows, a selection voltage is applied during the first half period ½H of one horizontal scanning period when the discrimination signal SG is high, and a selection voltage is applied during the second half period ½H of one horizontal scanning period when the discrimination signal SG is low.

Figure 7:
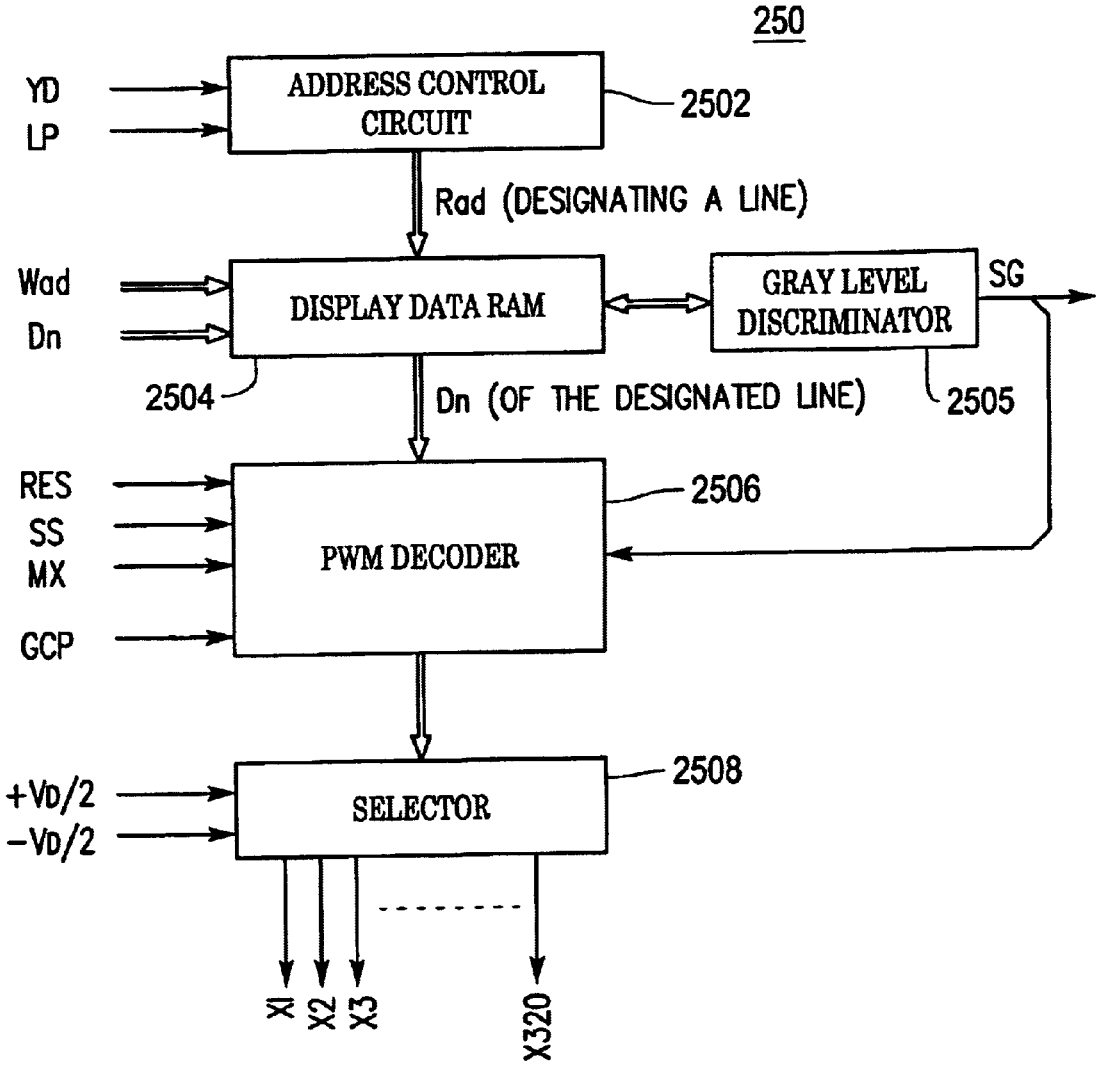
FIG. 7 is an exemplary block diagram illustrating the structure of an X driver of the display device.

The details of the data line driver circuit 250 are described below. FIG. 7 is a block diagram illustrating the structure of the data line driver circuit 250. In FIG. 7, an address control circuit 2502 generates a row address Rad used in reading of gray level data. In response to a start pulse YD supplied at the beginning of a frame, the address control circuit 2502 resets the row address Rad. Thereafter, the address control circuit 2502 increments the row address Rad in response to a latch pulse LP supplied every horizontal scanning period.

A display data RAM 2504 is a dual port RAM having a memory area corresponding to 240×320 pixels. On a writing side thereof, gray data Dn supplied from a processing circuit (not shown) is written at an address specified by a write address Wad. On a reading side, one line of gray level data for 320 pixels at an address specified by a row address Rad is read at the same time.

A gray level discriminating circuit 2505 prefetches gray level data for several lines stored at addresses preceding the address specified by row address Rad and, when a data signal is generated from the gray level data for one line prefetched by the row address Rad, generates a discrimination signal SG to specify which mode is to be used. Herein, in the present embodiment, the mode refers to the following operation modes. That is, in one mode, the scanning signals Y1, Y2, . . . , Y240 are generated so as to have a scanning pattern as shown in FIG. 5. In the other mode, the scanning signals Y1, Y2, . . . , Y240 are generated so as to have a scanning pattern as shown in FIG. 6. The criterion employed in determining the mode depending upon the prefetched gray level data will be described later.

A PWM decoder 2506 generates voltage selection signals used to select voltages of data signals X1, X2, . . . , X320 depending upon the 320 gray level data Dn, in accordance with a reset signal RES, an odd/even signal SS, an AC driving signal MX, a gray level code pulse GCP, and the discrimination signal SG.

In the present embodiment, the data voltages applied to the data lines 212 are equal to either +VD/2 or −VD/2. On the other hand, each gray level data Dn is represented by 3 bits (8 gray levels). Furthermore, as described above, for scanning lines 312 in odd-numbered rows, a selection voltage is applied during the second half period ½H of one horizontal scanning period regardless of the level of the discrimination signal SG, and, for scanning lines 312 in even-numbered rows, a selection voltage is applied during the first or second half period ½H depending upon the level of the discrimination signal SG.

Therefore, during a period in which the odd/even signal SS is high (one horizontal scanning period 1H during which a scanning line 312 in an odd-numbered row is selected), the PWM decoder 2506 generates a voltage selection signal regardless of the level of the discrimination signal SG. However, during a period in which the odd/even signal SS is low (one horizontal scanning period 1H during which a scanning line 312 in an even-numbered row is selected), the PWM decoder 2506 generates a voltage selection signal depending upon the level of the discrimination signal SG.

More specifically, for a period during which the odd/even signal SS is high, the PWM decoder 2506 generates a voltage selection signal regardless of the level of the discrimination signal SG so that the level of a data signal corresponding to one gray level data Dn becomes opposite to the level of the AC driving signal MX in response to a reset signal RES supplied at the beginning of the first half period ½H of one horizontal scanning period. Further, the data signal becomes equal to the level of the AC driving signal MX at a fall [high-to-low transition] of a gray level code pulse GCP corresponding to the gray level data Dn. Accordingly, a reset signal RES supplied at the beginning of the second half period ½H of the horizontal scanning period is neglected and the level of the data signal becomes equal to the level of the AC driving signal MX at a fall [high-to-low transition] of a gray level code pulse GCP corresponding to the gray level data Dn. However, when a gray level data Dn has a value (000) during a period in which the odd/even signal SS is at the high level, the PWM decoder 2506 generates a voltage selection signal so that the corresponding data signal has an opposite level to the level of the AC driving signal MX. In the case where a gray level data Dn has a value (111), the PWM decoder 2506 generates a voltage selection signal so that the corresponding data signal has the same level as the level of the AC driving signal MX.

On the other hand, for a period during which the odd/even signal SS is low, the PWM decoder 2506 generates a voltage selection signal as follows depending upon the level of the discrimination signal SG. That is, if the discrimination signal SG is high, the PWM decoder 2506 generates a voltage selection signal so that the level of a data signal corresponding to a gray level data Dn becomes the same as the level of the AC driving signal MX in response to a reset signal RES supplied at the beginning of the first half period ½H of one horizontal scanning period. Further, the signal becomes opposite to the level of the AC driving signal MX at a fall [high-to-low transition] of a gray level code pulse GCP corresponding to the gray level data Dn. Accordingly, a reset signal RES supplied at the beginning of the second half period ½H of the horizontal scanning period is neglected and the level of the data signal becomes opposite to the level of the AC driving signal MX at a fall [high-to-low transition] of a gray level code pulse GCP corresponding to the gray level data Dn. However, when a gray level data Dn has a value (000) during a period in which the odd/even signal SS is at the low level and the discrimination signal SG is at the high level, the PWM decoder 2506 generates a voltage selection signal so that the corresponding data signal has the same level as the level of the AC driving signal MX. In the case where a gray level data Dn has a value (111), the PWM decoder 2506 generates a voltage selection signal so that the corresponding data signal has an opposite level to the level of the AC driving signal MX.

On the other hand, for a period during which the odd/even signal SS is low, if the discrimination signal SG is low, the PWM decoder 2506 generates a voltage selection signal so that the level of a data signal corresponding to a gray level data Dn becomes opposite to the level of the AC driving signal MX in response to a reset signal RES supplied at the beginning of the first half period ½H of one horizontal scanning period. The data signal becomes the same as the level of the AC driving signal MX at a high-to-low transition of a gray level code pulse GCP corresponding to the gray level data Dn. Accordingly, a reset signal RES supplied at the beginning of the second half period ½H of the horizontal scanning period is neglected and the level of the data signal becomes the same as the level of the AC driving signal MX at a fall [high-to-low transition] of a gray level code pulse GCP corresponding to the gray level data Dn. However, when a gray level data Dn has a value (000) during a period in which the odd/even signal SS is at the high level, the PWM decoder 2506 generates a voltage selection signal so that the corresponding data signal has an opposite level to the level of the AC driving signal MX. In the case where a gray level data Dn has a value (111), the PWM decoder 2506 generates a voltage selection signal so that the corresponding data signal has the same level as the level of the AC driving signal MX.

The PWM decoder 2506 generates voltage selection signals for the 320 respective gray level data Dn. A selector 2508 selects a voltage specified by the voltage selection signal generated by the PWM decoder 2506 and supplies the selected voltage to a corresponding data line 212 one by one.

Thus, the data signal Xi supplied from the data line driver circuit 250 has a voltage waveform such as that shown in FIG. 8 when the discrimination signal SG is high and such as that shown in FIG. 9 when the discrimination signal SG is low, wherein, in FIGS. 8 and 9, gray level data Dn input to the PWM decoder 2506 is represented in binary numbers and data signals Xi decoded from the gray level data Dn are shown.

Figure 11:
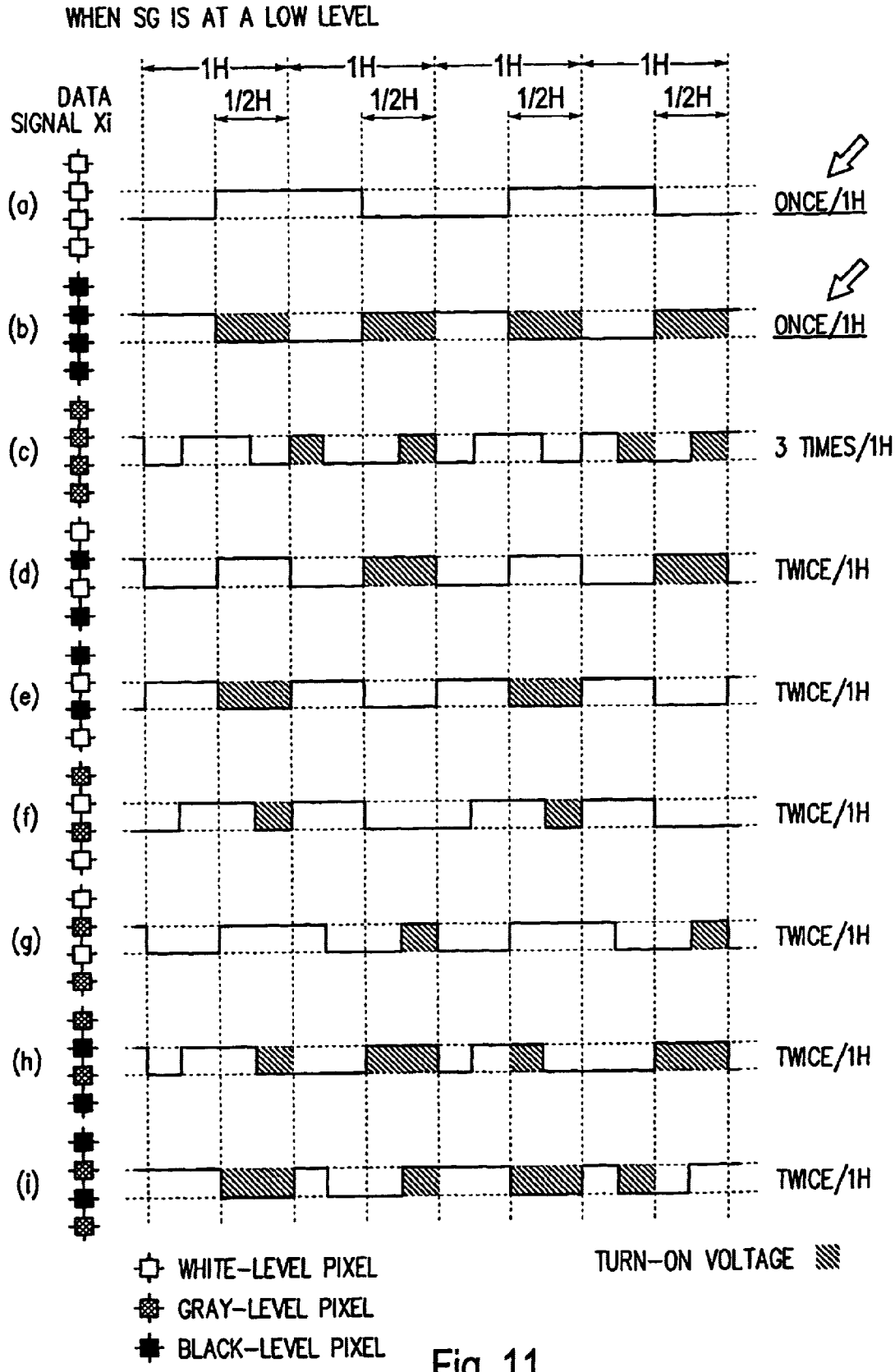
FIG. 11 is a timing chart illustrating voltage waveforms of the data signal Xi for various combinations of gray levels for the case in which the discrimination signal SG is at a low level.

The data signal Xi can have various voltage waveforms depending upon the content to be displayed at a pixel and depending upon whether the discrimination signal SG is high or low, as described below. FIG. 10 illustrates voltage waveforms the data signal Xi can have when the discrimination signal SG is high. FIG. 11 illustrates voltage waveforms the data signal Xi can have when the discrimination signal SG is low. In both figures, there are shown waveforms of the data signal Xi for cases in which colors displayed by four pixels 116 at successive locations along a column are (a) white-white-white-white, (b) black-black-black-black, (c) gray-gray-gray-gray, (d) white-black-white-black, (e) black-white-black-white, (f) gray-white-gray-white, (g) white-gray-white-gray, (h) gray-black-gray-black, and (i) black-gray-black-gray. Herein, the term "gray" is used to generically describe intermediate gray levels other than black and white . More specifically, in the present embodiments, gray levels include those corresponding to gray level data (001), (010), (011), (100), (101), and (110).

As can be seen from FIGS. 10 and 11, in the case where the colors displayed by four pixels 116 at successive locations along a column are one of following combinations, (f) gray-white-gray-white, (g) white-gray-white-gray, (h) gray-black-gray-black, and (i) black-gray-black-gray, the voltage level of the data signal Xi is switched twice during one horizontal scanning period 1H regardless of the level of the discrimination signal SG. However, in the case where the colors displayed by four pixels 116 at successive locations along a column are one of following combinations, (c) gray-gray-gray-gray, (d) white-black-white-black, and (e) black-white-black-white, when the discrimination signal SG is high, the voltage level of the data signal Xi is switched one time fewer in each horizontal scanning period than when the discrimination signal SG is low. On the other hand, in the case where the colors displayed by four pixels 116 at successive locations along a column are one of combinations (a) white-white-white-white and (b) black-black-black-black, when the discrimination signal SG is high, the voltage level of the data signal Xi is switched one time more in each horizontal scanning period than when the discrimination signal SG is low.

Because the electric power consumption decreases with decreasing number of times the voltage of the data signal Xi is switched (per unit time) as described earlier, the gray level discrimination circuit 2505 determines the level of the discrimination signal SG in the manner described below thereby specifying the mode. That is, when the prefetched gray level data Dn of pixels 116 include a data representing gray, the gray level discrimination circuit 2505 basically sets the discrimination signal SG to a high level during a horizontal scanning period in which the pixel which is to display gray is selected (wherein the setting of the discrimination signal SG is performed at the beginning of that horizontal scanning period). However, in a given particular horizontal scanning period, if the number of successive pixels displaying gray is smaller than the number of successive pixels displaying white or black, the gray level discrimination circuit 2505 sets the discrimination signal SG to have a low level during that horizontal scanning period.

That is, if the 320 pixels 116 located along a given scanning line 312 include pixels which have successive neighboring gray pixels along a column, the discrimination signal SG is set to a high level so that the number of times the voltage of the data signal is switched per horizontal scanning period decreases from 3 to 2 thereby achieving a reduction in the power consumption. However, when there are pixels having successive neighboring gray pixels along a column and pixels having successive neighboring white or black pixels and if the number of latter pixels is greater than the number of former pixels, the good effect obtained by reducing the number of times from 3 to 2 for the former pixels is smaller than the bad effect resulting from the increase in the number of times from 1 to 2 for the latter pixels, and thus the overall effect is an increase in the power consumption. Therefore, in such a case, the discrimination signal is set to a low level to avoid the increase in the power consumption.

In the case where the prefetched gray level data Dn of pixels 116 include no gray data (that is, the prefetched gray level data Dn include only white or black data) the gray level discrimination circuit 2505 basically sets the discrimination signal SG to have a low level during a horizontal scanning period in which those pixels are selected (wherein the setting of the discrimination signal SG is performed at the beginning of that horizontal scanning period). However, in a particular horizontal scanning period of interest, the number of pixels having successive neighboring pixels along a column alternately having black and white pixels is equal to or greater than one-half the total number of pixels along the scanning line, the gray level discrimination circuit 2505 sets the discrimination signal SG to have a high level during that horizontal scanning period.

That is, if, of 320 pixels 116 located along a scanning line 312 of interest, the number of pixels having successive neighboring white or black pixels along a column is greater than the number of pixels having successive neighboring pixels along a column alternately having black and white pixels, the good effect obtained by reducing the number of times from 2 to 1 for the former pixels is greater than the bad effect resulting from the increase in the number of times from 1 to 2 for the latter pixels, and thus the overall effect is an reduction in the power consumption. However, if the number of pixels having successive neighboring white or black pixels along a column is smaller than the number of pixels having successive neighboring pixels along a column alternately having black and white pixels, the good effect obtained by reducing the number of times from 2 to 1 for the former pixels is smaller than the bad effect resulting from the increase in the number of times from 1 to 2 for the latter pixels, and thus the overall effect is an increase in the power consumption. Therefore, in such a case, the discrimination signal is set to a high level to avoid the increase in the power consumption.

In the display device according to the present embodiment, as described above, when gray levels are displayed (by pixels) the discrimination signal SG is basically set to a high level, while the discrimination signal SG is basically set to a low level when gray levels are not displayed (that is, white or black is displayed by pixels), thereby reducing the number of times the voltage of the data signal is switched and thus achieving a reduction in power consumption.

However, even when gray levels are displayed, if the setting of the discrimination signal SG to a high level exceptionally causes an increase in power consumption, the discrimination signal SG is set to a low level. Conversely, when no gray levels are displayed, if the setting of the discrimination signal SG to a low level exceptionally causes an increase in power consumption, the discrimination signal SG is set to a high level. Thus, an exceptional increase in power consumption is prevented.

In the embodiment described above, the selection period during which a selection voltage is applied to a scanning line 312 in an odd-numbered row is fixed to the second half period of a horizontal scanning period, while the first or second half period of a horizontal scanning period is employed, depending upon the level of the discrimination signal, as the selection period during which a selection voltage is applied to a scanning line 312 in an even-numbered row. Alternatively, the selection period during which a selection voltage is applied to a scanning line 312 in an odd-numbered row may be varied between the first or second half period of a horizontal scanning period depending upon the level of the discrimination signal, and the selection period during which a selection voltage is applied to a scanning line 312 in an odd-numbered row may be fixed to the second half period of a horizontal scanning period.

Furthermore, although in the above-described embodiment, the gray level discrimination circuit 2505 determines the level of the discrimination signal SG to specify the mode, it is to be understood that the present invention is in no way limited to that.

For example, a processing circuit (not shown) which supplies gray data Dn to the C driver 250 may determine the level of the discrimination signal SG depending upon an execution result of an application program, or a user may specify the discrimination signal SG by operating a switch provided for that purpose.

In FIG. 1, each TFD 220 is connected to a corresponding data line 212, and each liquid crystal layer 118 is connected to a corresponding scanning line 312. Alternatively, each TFD 220 may be connected to a scanning line 312, and each liquid crystal layer 118 may be connected to a data line 212.

The TFDs 220 used as switching elements in the liquid crystal panel 100 may be replaced with another type of two-terminal switching elements such as a ZnO (zinc oxide) varister, an MIS (Metal Semi-Insulator) element, a series or parallel connection of two such elements in opposite directions, or a three-terminal element such as a TFT (Thin Film Transistor) or an insulating gate field effect transistor.

In the case in which TFTs are employed as the switching elements, TFTs may be formed, for example, by first forming a thin silicon film on the surface of the device substrate 200, and then forming sources, drains, and channels in the thin silicon film. In the case in which insulating gate field effect transistors are employed as the switching elements, they may be formed, for example, by employing a semiconductor substrate as the device substrate 200 and forming sources, drains, and channels on the surface of the semiconductor substrate. In this case, however, because the semiconductor substrate is not transparent to light, the pixel electrodes 234 are formed of metal such as aluminum such that the pixel electrodes 234 serve as reflective electrodes, and thus the resultant display device serves as a reflective type display device.

In the case in which three-terminal elements are used as the switching elements, not only either the data lines 212 or the scanning lines 312 are formed on the device substrate 200, but both the data lines 212 and the scanning lines 213 are needed on the device substrate 200 such that they cross each other on the same device substrate 200. This results in an increase in the risk of forming of a short-circuited path. Furthermore, TFTs are more complicated in structure than TFDs, and thus a more complicated production process is needed to produce TFTs.

The present invention may also be applied to a passive liquid crystal display which uses STN (Super Twisted Nematic) liquid crystal and which does not need switching elements such as TFDs or TFTs. The pixel electrodes 234 may be formed of reflective metal or an additional reflecting layer may be formed under the pixel electrodes 234 so that the display device serves as a reflective device. Furthermore, the reflecting layer may be formed so as to be very thin so that the display device serves as a transflective device.

In the display device described above, a liquid crystal is used as the electrooptical material. However, it is to be understood that the present invention may also be applied to a display device which displays an image using an electrooptical effect, such as an electroluminescence display, a fluorescent display tube, or a plasma display. That is, the present invention may be applied to any display device having a similar structure to that described above. Some specific examples of electronic devices using the above-described display device are described below.

Figure 19:
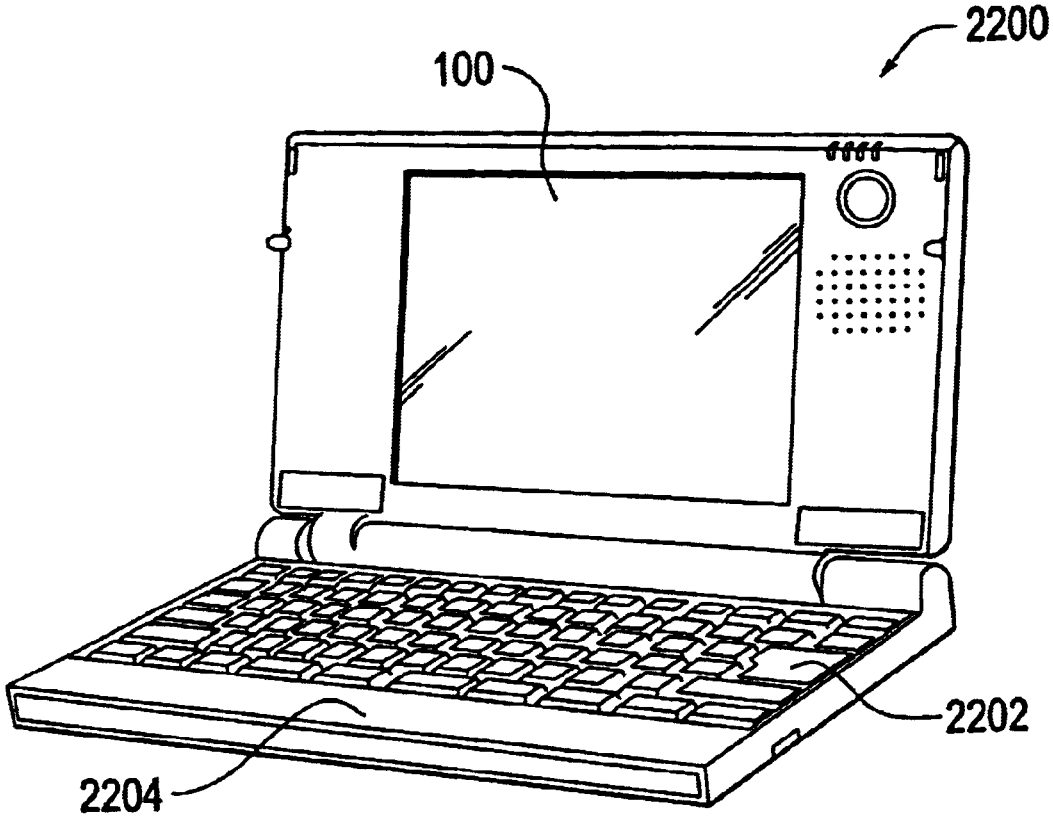
FIG. 19 is a perspective view illustrating a structure of a personal computer which is an example of an electronic device using the display device.

An example of a mobile personal computer using the above-described display device as its display is described below. FIG. 19 is a perspective view illustrating the structure of the personal computer. In FIG. 19, the personal computer 2200 includes a main part 2204 having a keyboard 2202 and a liquid crystal panel 100 serving as a display. Although a backlight device is disposed on the back of the liquid crystal panel 100 to achieve good visibility, it cannot be viewed from the outside, and thus it is not shown in FIG. 19.

Figure 20:
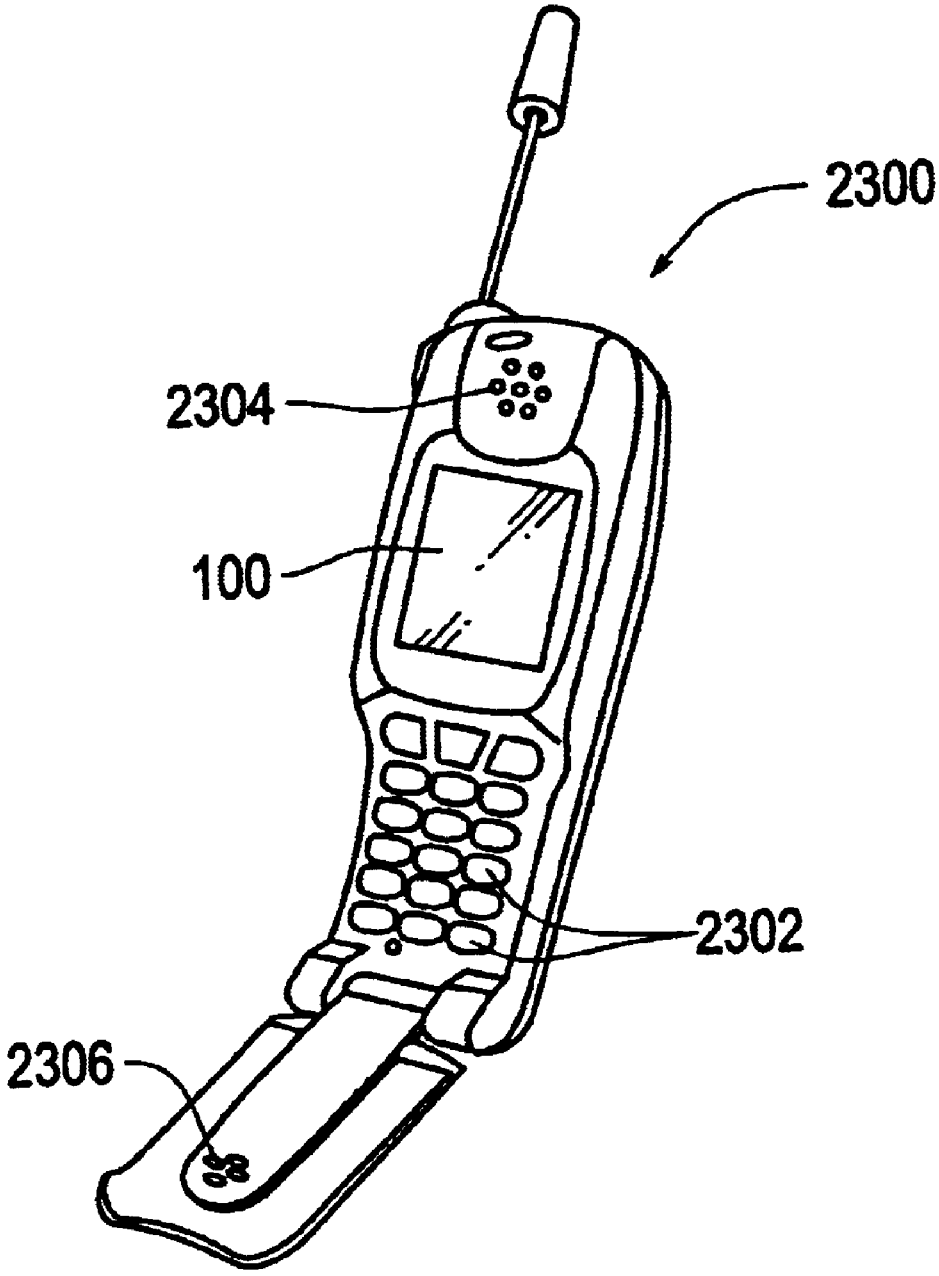
FIG. 20 is a perspective view illustrating a structure of a portable telephone which is an example of an electronic device using the display device.

An example of a portable telephone using the above-described display device as its display is described below. FIG. 20 is a perspective view illustrating the structure of the portable telephone. In FIG. 20, the portable telephone 2300 includes a plurality of operation control buttons 2302, an earpiece 2304, a mouthpiece 2306, and the above-described liquid crystal panel 100. Also in this portable telephone, a backlight device is disposed on the back of the liquid crystal panel 100 to achieve good visibility, it cannot be viewed from the outside, and thus it is not shown in FIG. 20.

Figure 21:
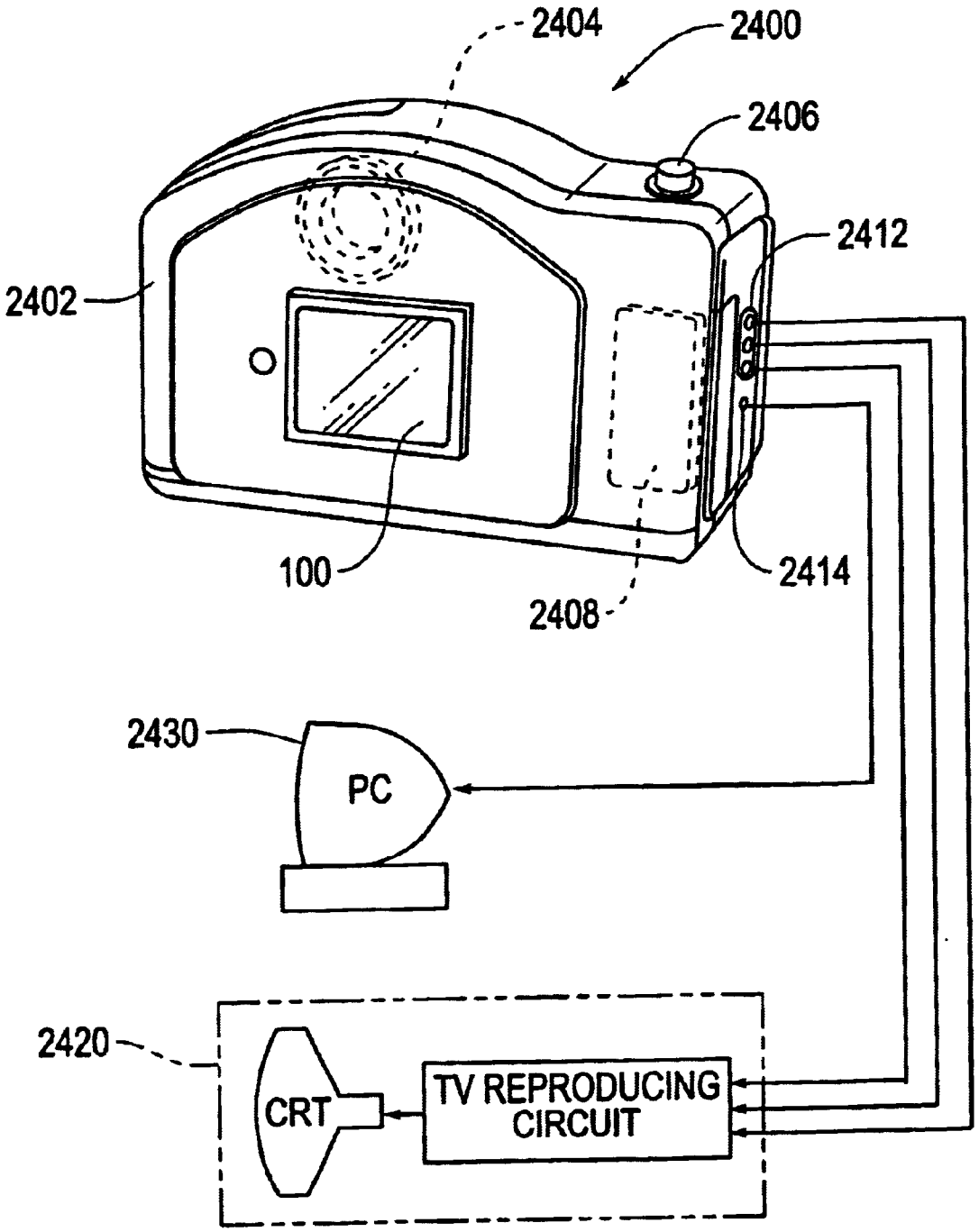
FIG. 21 is a perspective view illustrating a structure of a digital still camera which is an example of an electronic device using the display device.

An example of a digital still camera using the above-described display device as its viewfinder is described below. FIG. 21 is a perspective view illustrating the structure of the digital still camera, wherein external devices connected to the digital still camera are also shown.

In conventional cameras, a film is exposed to an optical image of a subject. In contrast, in the digital still camera 2400, an optical image of a subject is converted into an electric signal by an imaging device such as a CCD (Charge Coupled Device) thereby producing an image signal. The digital still camera 2400 includes the above-described liquid crystal panel 100 disposed on the back of a case 2402 so that an image is displayed on the liquid crystal panel 100 in accordance with the image signal output from the CCD and thus the liquid crystal panel 100 serves as a viewfinder for displaying an image of a subject. A photo sensing unit 2404 including an optical lens and the CCD is disposed on the front side (back side in FIG. 21) of the case 2402.

When a human operator decides to take a picture displayed on the liquid crystal panel 100, he/she presses a shutter button 2406. In response, the image signal produced by the CCD at that moment is transferred to a memory on a circuit board 2408 and stored therein. In this digital still camera 2400, a video signal output terminal 2412 and a data communication input/output terminal 2414 are disposed on a side face of the case 2402. As shown in FIG. 21, as required, a television monitor 2420 can be connected to the video signal output terminal 2412 and a personal computer 2430 can be connected to the data communication input/output terminal 2414. If a predetermined operation is performed, the image signal stored in the memory on the circuit board 2408 is output to the television monitor 2420 or the personal computer 2430.

In addition to the personal computer shown in FIG. 19, the portable telephone shown in FIG. 20, and the digital still camera shown in FIG. 21, the display device according to the present invention may also be used in other various electronic devices such as a liquid crystal television, a video tape recorder with a viewfinder or a monitor, a car navigation device, a pager, an electronic notepad, a calculator, a word processor, a workstation, a video telephone, a POS terminal, a device including a touch panel, or the like without departing from the spirit and scope of the present invention.

According to the present invention, as described above, it is possible to reduce the number of times the voltage levels of signals applied to the data lines are switched in an operation of displaying a gray-scale image. As a result, a reduction in electric power consumed when the voltage levels are switched can be achieved.

What is claimed is:

1. A method of driving a display device so as to display a gray-scale image by driving pixels disposed at locations corresponding to respective intersections of a plurality of scanning lines extending along rows and a plurality of data lines extending along columns, said method comprising:

selecting a single scanning line from said plurality of scanning lines during one horizontal scanning period;

applying a selection voltage to said single scanning line during one of a half period of said horizontal scanning period;

selecting a second single scanning line adjacent to the previously selected single scanning line during a subsequent one horizontal scanning period;

applying a selection voltage to said second single scanning line during another one of the half periods of said one horizontal scanning period;

simultaneously applying a turn-on or turn-off voltage to a pixel at a location corresponding to a selected scanning line via a corresponding data line such that the turn-on voltage is applied during a period with a length corresponding to a gray level in the period during which said selection voltage is applied, and the turn-off voltage is applied during the remaining period.

2. The method of driving a display device according to claim 1, further comprising: specifying whether a mode should be changed, wherein if said specifying step specifies that the mode should be changed, when said second single scanning line is selected in said subsequent one horizontal scanning period, the selection voltage is applied to said second single scanning line during one of half periods of said horizontal scanning period.

3. The method of driving a display device according to claim 2, wherein when a number of pixels successively aligned a long a column in which pixels that will be displayed in a single color of either black or white exceeds a predetermined number of pixels located along a single scanning line that will be selected, said specifying step specifies that the mode should be changed.

4. The method of driving a display device according to claim 2, wherein when the number of pixels successively aligned along a column in which black and white pixels will be displayed alternately exceeds a predetermined number of pixels located along a single scanning line that will be selected, said specifying step specifies that the mode should not be changed.

5. A driver circuit for driving a display device so as to display a gray-scale image by driving pixels disposed at locations corresponding to respective intersections of a plurality of scanning lines extending along rows and a plurality of data lines extending along columns, said driver circuit comprising:

a scanning line driver circuit that:

selects out of said plurality of scanning lines a single scanning line during one horizontal scanning period, applies a selection voltage to said scanning line during one of two half periods that said horizontal scanning period has been divided into, selects a single scanning line adjacent to the previously selected scanning line during a subsequent horizontal scanning period, and applies a selection voltage to said adjacent scanning line during another of the two half periods that said horizontal scanning period has been divided into; and a data line driver circuit that applies a turn-on or turn-off voltage to a pixel at a location corresponding to the single scanning line selected by said scanning line driver circuit via a corresponding data line, such that the turn-on voltage is applied during a period with a length corresponding to a gray level in the period during which said selection voltage is applied, and the turn-off voltage is applied during the remaining period.

6. A display device for displaying a gray-scale image by driving pixels disposed at locations corresponding to respective intersections of a plurality of scanning lines extending along rows and a plurality of data lines extending along columns, said display device comprising:

a scanning line driver circuit that:

selects out of said plurality of scanning lines a scanning line during one horizontal scanning period, applies a selection voltage to said scanning line during one of two half periods that said horizontal scanning period has been divided into, selects a single scanning line adjacent to the previously selected scanning line during a subsequent horizontal scanning period, and applies a selection voltage to said adjacent scanning line during another of the two half periods that said horizontal scanning period has been divided into; and a data line driver circuit that applies a turn-on or turn-off voltage to a pixel at a location corresponding to the single scanning line selected by said scanning line driver circuit via a corresponding data line, such that the turn-on voltage is applied during a period with a length corresponding to a gray level in the period during which said selection voltage is applied, and the turn-off voltage is applied during the remaining period.

7. The display device according to claim 6, wherein said pixel includes a switching element and a capacitor driven by said switching element.

8. The display device according to claim 7, wherein said switching element is a thin film diode having a conductor/insulation/conductor structure, and one end of said thin film diode is connected to either said scanning line or said data line, the other end being connected to said capacitor.

9. An electronic device including a display device according to claim 6.

* * * * *